US012398551B2

(12) United States Patent
Parsons et al.

(10) Patent No.: US 12,398,551 B2
(45) Date of Patent: Aug. 26, 2025

(54) BALCONY

(71) Applicant: SAPPHIRE BALCONIES LIMITED, Reading (GB)

(72) Inventors: Andrew Parsons, Reading (GB); Tim Hill, Reading (GB)

(73) Assignee: SAPPHIRE BALCONIES LIMITED (GB)

( * ) Notice: Subject to any disclaimer, the term of this patent is extended or adjusted under 35 U.S.C. 154(b) by 171 days.

(21) Appl. No.: 18/252,507

(22) PCT Filed: Nov. 26, 2021

(86) PCT No.: PCT/EP2021/083180
§ 371 (c)(1),
(2) Date: May 10, 2023

(87) PCT Pub. No.: WO2022/112505
PCT Pub. Date: Jun. 2, 2022

(65) Prior Publication Data

US 2023/0417040 A1 Dec. 28, 2023

(30) Foreign Application Priority Data

Nov. 26, 2020 (GB) ..... 2018643

(51) Int. Cl.
*E04B 1/00* (2006.01)
*E04B 1/24* (2006.01)

(52) U.S. Cl.
CPC ..... *E04B 1/003* (2013.01); *E04B 2001/2415* (2013.01); *E04B 2001/2424* (2013.01)

(58) Field of Classification Search
CPC ..... E04B 1/003; E04B 2001/2424; E04B 2001/2415
See application file for complete search history.

(56) References Cited

U.S. PATENT DOCUMENTS

| | | | | |
|---|---|---|---|---|
| 2014/0026514 | A1* | 1/2014 | Davis | E04H 3/24 52/645 |
| 2017/0009441 | A1* | 1/2017 | Catteau | E04B 1/41 |
| 2019/0003172 | A1* | 1/2019 | Vanker | E04B 1/34 |

FOREIGN PATENT DOCUMENTS

| | | | | |
|---|---|---|---|---|
| AU | 2022228082 | A1 * | 3/2023 | |
| DE | 19654537 | A1 * | 7/1998 | E04B 1/003 |
| DE | 20316406 | U1 * | 2/2004 | E04B 1/003 |
| DE | 202010007467 | U1 * | 11/2010 | A47B 57/408 |
| DE | 202021106979 | U1 * | 3/2022 | |
| DE | 202023104824 | U1 * | 1/2024 | |
| EP | 1477400 | A1 | 11/2004 | |
| EP | 3872272 | A1 * | 9/2021 | E04B 1/003 |
| GB | 2595538 | A * | 12/2021 | E04B 1/003 |
| JP | S55123502 | U | 9/1980 | |
| JP | S57154459 | U | 9/1982 | |
| JP | H04261932 | A | 9/1992 | |
| JP | H0688375 | A | 3/1994 | |
| KR | 101353491 | B1 * | 1/2014 | |

OTHER PUBLICATIONS

UKIPO Search Report, Application No. GB-2018643.3, dated May 13, 2021, 1 page.
UKIPO Search Report, Application No. GB-2018643.3, dated May 17, 2021, 1 page.
International Search Report & Written Opinion, International Application No. PCT/EP2021/083180, dated Mar. 24, 2022, 13 pages.
International Preliminary Report on Patentability—Chapter II, International Application No. PCT/EP2021/083180, dated Feb. 14, 2023, 24 pages.
International Second Written Opinion—Chapter II, International Application No. PCT/EP2021/083180, dated Aug. 29, 2022, 12 pages.

* cited by examiner

*Primary Examiner* — Theodore V Adamos
(74) *Attorney, Agent, or Firm* — Quarles & Brady LLP

(57) ABSTRACT

A balcony for attachment to a construction, there being a plurality of wall brackets fitted to the construction, the balcony comprising: a plurality of balcony brackets on one side of the balcony which are arranged to engage with the plurality of wall brackets, including a first balcony bracket arranged to engage with a first wall bracket and a second balcony bracket arranged to engage with a second wall bracket, so as to cause the weight of the balcony to be supported by the construction when the balcony is arranged in a mounted position, wherein the first balcony bracket is spaced apart from the second balcony bracket in a substantially vertical direction; and a latch assembly which is configured, when the balcony is arranged in the mounted position, to latch the first balcony bracket to the first wall bracket to securely attach the balcony to the construction.

14 Claims, 20 Drawing Sheets

BALCONY

RELATED APPLICATIONS

This application is a 35 U.S.C. § 371 national phase application of PCT/EP2021/083180 (WO 2022/112505 A1), filed on Nov. 26, 2021, entitled "A BALCONY" which claims priority to GB-2018643.3 filed on Nov. 26, 2020, which are incorporated herein by reference in their entirety.

FIELD OF THE INVENTION

The present invention relates to a balcony, a balcony system and to a method of fitting a balcony to a building or other structure.

BACKGROUND OF THE INVENTION

Metal balconies are often specified in the plans drawn up by architects for new or existing buildings. These balconies may be decorative, but in many cases must be structurally secure and capable of supporting the load of several people as well as the furniture (balustrades, panels, handrails, etc.) needed to make the balcony safe.

In existing approaches, a metalworker will generally attend the site to bolt 'stubs' onto/into the concrete frame or floor slab or onto anchors retained in the frame or slab while the basic structure of the building is being constructed. At a later stage, often after the main structure of the building, including building fascia (e.g. brickwork) and windows is complete, a frame for the balcony is manufactured off site from galvanised mild steel or aluminium, and transported to site. The balcony frame is then lifted by crane and held aloft adjacent to the stubs whilst the frame is firstly aligned with the stubs and then bolted onto them by workers working underneath or adjacent the loose balcony.

Whilst this method has been followed for many years and produces acceptable results, there are a number of problems with this process.

Firstly, there is a safety risk for the workers who are aligning the balcony and bolting it in place. These workers normally have to either work from either an elevated platform (a "cherry picker"), on a scaffold tower from the ground level or the floor below, or accessing the loose balcony via an opening in the building. There is inevitably a risk of falling associated with such work at height. Furthermore there are risks associated with the manual handling of trying to push the balcony into position, and a risk of trapping hands and fingers when trying to get the balcony into position and bolted on. These risks are increased because of the length of time it takes to fix a balcony using this method (see below).

Secondly, it takes a substantial amount of time to install each balcony using this method. The crane has to stay in position supporting the balcony in mid-air while the workers align and bolt the balcony firmly in place. The workers then have to move all their access equipment and tools up to the next floor or balcony location before they can start the next one. As a result, the delivery driver also has to stay on site whilst each of the balconies is lifted into position one at a time through the day. Alternatively, the balconies can be removed from the delivery vehicle and temporarily stored at the construction site until they can be lifted into position, which requires double-handling of the balconies.

The present invention aims to address one or more of the above problems with existing balcony construction and fitting processes.

SUMMARY OF THE INVENTION

Accordingly, at their broadest, aspects of the present invention provide a balcony comprising a latch assembly which is configured to securely fasten the balcony to the construction without requiring any input from a worker; and a method of latching a latch assembly of a balcony to securely attach, or fasten, the balcony to a construction.

A first aspect of the present invention provides a balcony for attachment to a construction, there being a plurality of wall brackets fitted to the construction. The balcony has a plurality of balcony brackets on one side of the balcony which are arranged to engage with the plurality of wall brackets, including a first balcony bracket arranged to engage with a first wall bracket and a second balcony bracket arranged to engage with a second wall bracket, so as to cause the weight of the balcony to be supported by the construction when the balcony is arranged in a mounted position. The first balcony bracket is spaced apart from the second balcony bracket in a substantially vertical direction and the balcony comprises a latch assembly which is configured, when the balcony is arranged in the mounted position, to latch the first balcony bracket to the first wall bracket to securely attach the balcony to the construction.

The latch assembly enables the balcony to be secured to the construction as the balcony is moved into the mounted position. The weight of the balcony is supported by the first and second wall brackets so that the latch assembly can provide a semi-permanent means of securing the first balcony bracket to the first wall bracket so that the balcony cannot be dislodged whilst workers complete its installation to the construction. In this way, the latching assembly allows the balcony to be mounted (i.e. moved into a mounted position on the construction) and secured to the construction in a single act, or motion.

It will be understood that the latch assembly defines a means of mechanically engaging the first wall bracket to the first balcony bracket, e.g. without requiring any manipulation by a worker. Therefore, the latch assembly may be configured to mechanically secure the balcony in the mounted position without the need for a worker to be present in the immediate vicinity of the installation, thereby reducing the risk to the worker tasked with installing the balcony.

According to an exemplary method of attaching the balcony to the construction, the balcony may be initially lifted into position by a crane. Once, or after, the balcony has been moved into the mounted position its entire weight may be supported by the first and second wall brackets, and the latch assembly is then able to secure the balcony to the first wall bracket so that the crane is no longer required to support the balcony's weight. As a result, the crane is free to perform other tasks during the remainder of the balcony installation process.

When making adjustments to the balcony (once it has been latched to the construction), the workers may position themselves within the construction and then reach out onto the balcony in order to complete the balcony installation. By securing the balcony to the construction as it is mounted into position, the workers can be reassured that the balcony will not move away from the construction as they work on the installation.

Throughout the description, any references to "upper", "lower", "above" or "below" are intended to refer to the balcony when it is arranged in use, i.e. when the balcony is arranged in a mounted position on the construction. Any references to "inner" or "outer" are intended to refer to regions, portions, or sides of the balcony which lie near (e.g.

nearest) and far (e.g. farthest) from the construction, respectively. For example, an inner side of the balcony may refer to the side of the balcony which is adjacent to the construction, whereas an outer side of the balcony may refer to a cantilevered side of the balcony. Accordingly, the inner side of the balcony may define a construction facing side of the balcony. Furthermore, any references to "left" or "right" refer to the associated regions, portions, or sides of the balcony when viewed facing the building (i.e. facing toward the construction).

Optional features will now be set out. These are applicable singly or in any combination with any aspect.

The latch assembly may be attached to the first wall bracket, and configured to latch onto the first balcony bracket in order to secure the balcony to the construction. Alternatively, the latch assembly may be attached to the first balcony bracket and configured to latch onto the first wall bracket. It will be appreciated that, unless specified otherwise, each of the features of the latch assembly described hereinafter may apply to either of the above described arrangements. As such, the term 'bracket' may refer to either the wall bracket or the balcony bracket, depending on the configuration of the latch assembly.

The latch assembly may comprise a latch which is configured to be movable from an unlatched configuration to a latched configuration by the balcony being moved into the mounted position. In this way, the unlatched configuration defines the arrangement, or position, of the latch before the balcony is moved into the mounted position, and the latched configuration defines the arrangement of the latch once, or after, the balcony is arranged in the mounted position. Accordingly, it is the movement of the balcony towards the construction which causes the latch to move from the unlatched to the latched configuration, as the first balcony bracket is engaged with the first wall bracket.

The latch may be pivotably coupled to the balcony about a substantially horizontal pivot axis to allow rotation of the latch in a substantially vertical plane. The latch may extend, in a radial direction, away from the pivot axis, and may be rotatable about the horizontal axis in the substantially vertical plane. This rotational movement enables a free end of the latch to be raised, or lowered, in order to latch the first balcony bracket to the first wall bracket. The horizontal pivot axis may be arranged such that it is substantially parallel to an external wall of the construction (to which the balcony is being mounted) and the substantially vertical latch rotation plane may be perpendicular to that external wall of the construction.

The latch assembly may comprise a latch support which may be configured to support the latch in the unlatched configuration. In this way, the latch support ensures that the latch is ready to be moved from the unlatched configuration to the latched configuration, as the balcony is moved into its mounted position.

The latch assembly may comprise a tapered leading end which is configured to engage with the latch. The tapered leading end may be arranged on either the first wall bracket or the first balcony bracket, and the latch may be attached to the other of the first wall bracket and the first balcony bracket. The tapered leading end may be configured, when the balcony is moved into the mounted position, to urge the latch from the unlatched configuration to the latched configuration in order to latch the first wall and balcony brackets together. The tapered leading end provides a ramp, or guide, which guides the latch into the latched configuration.

The tapered leading end may define at least a portion of a surface of the bracket which is arranged to face the opposing bracket to which it is latched. For example, the leading end of the first wall bracket may be arranged to face the first balcony bracket, when the balcony is being moved into the mounted position. In embodiments, the tapered leading end may define an upper and/or lower portion of the bracket.

The latch assembly may further comprise a latch receiving portion to receive the latch when it is arranged in the latched configuration. The latch receiving portion may be arranged rearward of the tapered leading end of the bracket such that the latch may be guided into the latch receiving portion by the tapered leading end. The latch assembly may comprise a concave depression, which defines the latch receiving portion. The concave depression may be arranged on an upper surface of the bracket. Accordingly, the concave depression may be configured (i.e. shaped or dimensioned) to receive the latch when it is arranged in the latched configuration. The latch receiving portion may be generally hook-shaped.

The concave depression of the latch receiving portion may comprise a retaining wall which is configured to substantially prevent vertical movement of the latch once the latch is received within the concave depression. The retaining wall may comprise a curved surface which is configured to match a portion of an outer surface of the latch. The curved surface may be arranged, when in use, to face substantially away from the latch so that the latch can hook against the curved surface. The curved surface may be configured to face in an opposite direction to the direction in which the tapered leading end is arranged to face.

The latch assembly may comprise a first member which is pivotably coupled to either the first wall bracket or the first balcony bracket. The latch assembly may comprise a second member which forms the latch. The first member may be adjustably coupled to the second member to allow relative movement therebetween. Accordingly, once the latch is arranged in the latched configuration, it can be tightened against the latch receiving portion by adjusting the coupling between the first and second members of the latch assembly.

The latch assembly may include an elastic member configured to urge the latch towards the latched configuration and to permit movement of the latch towards the unlatched configuration. The elastic member may for example be a spring. The elastic member may be attached at one end to the latch and at the other end to an anchor fixed with respect to the balcony.

In embodiments, the first member is coupled to the balcony (i.e. the first balcony bracket) such that the second member (i.e. the latch) is arranged to latch with the first wall bracket when the balcony is moved into its mounted position.

The second member may comprise a threaded bore and a threaded end of the first member may be configured to be received within the threaded bore to control the relative movement between the first and second members. The threaded coupling between the first and second members allows for their relative movement to be finely adjusted. The threaded bolt, or stud, of the first member may be configured to enter the bore at one side of the bore and protrude from the opposite side of the bore.

In an alternative exemplary arrangement, the second member may be configured with a smooth bore (i.e. non-threaded bore) which is arranged to receive a threaded end of the first member. The bore may extend completely through the second member. The threaded stud of the first member may be secured in position relative to the second member by a nut, or any other suitable fastening.

The first member may comprise a bolt and a yoke block, or pivot block, having a bore through which the bolt extends and within which bore the bolt is rotatable. A threaded end of the bolt may define the threaded end of the first member, as described herein. The bolt may comprise a latch adjustment head which can be manipulated to adjust the threaded coupling between the first and second members.

The bolt may be secured in position relative to the yoke block by at least one securing nut. The at least one securing nut may be arranged either side of the yoke block. For example, the securing nut may be arranged between the yoke block and the latch, and may be configured to tighten against the yoke block in order to secure the latch in place once it has been tightened against the latch receiving portion. The arrangement of the securing nut between the latch and the yoke block prevents the latch from being urged away from the wall bracket as the latch engages the tapered leading end of the latch assembly (i.e. by limiting the movement of the bolt relative to the yoke block).

The yoke block of the first member may be pivotably attached by its lateral ends to the bracket (i.e. the first wall bracket or the first balcony bracket). The bore of the first member may be axially aligned perpendicular to a pivot axis of the first member, such that the second member is aligned in a perpendicular direction to the pivot axis of the first member.

The first member may be supported by a pair of support structures of the bracket, which are arranged either side of the lateral ends of the yoke block. A pair of screws (e.g. countersunk screws) may be configured to connect with the lateral ends of the yoke block of the first member to the support structures and thereby allow the first member to pivot, or rotate, about its pivot axis.

The second member (i.e. the latch) may comprise a yoke which is configured to engage with the latch receiving portion of the latch assembly. The yoke may comprise a yoke pin which extends between two side supports. According to an exemplary arrangement, the two side supports define a substantially U-shaped member. Accordingly, the yoke pin may be arranged to extend between the free ends of the U-shaped member. Alternatively, the yoke pin may be configured to protrude from a single side support.

The yoke may be configured such that the yoke pin is arranged in a substantially horizontal alignment when the latch assembly is arranged in the unlatched and/or latched configurations. The horizontal alignment of the yoke pin enables the latch assembly to engage with a vertical wall of the latch receiving portion of the latch assembly.

The first member may be attached to the first balcony bracket at a location which is distanced away from the construction-facing side of the balcony. The second member (e.g. the latch) may be configured to extend from the first member, in a substantially horizontal direction (e.g. towards the construction), when the latch is arranged in the unlatched configuration. In this way, the latch is positioned so that it is ready to engage with the tapered leading end of the first wall bracket, and then be guided into the latched configuration as the balcony is moved into the mounted position.

The first wall bracket and the first balcony bracket may, together, define a first attachment of the balcony. The second wall bracket and the second balcony bracket may, together, define a second attachment of the balcony. The first balcony bracket may be arranged substantially above the second balcony bracket. The first wall bracket may be arranged substantially above the second wall bracket so as to correspond with the respective first and second balcony brackets. Accordingly, the first and second attachments may define, respectively, upper and lower attachments of the balcony.

Known balconies are configured such that their weight is supported by a floor structure of the building, which defines a particularly strong portion of the structure. The weight of the balconies is, therefore, concentrated within a single horizontal plane of the building (which is parallel with the floor structure). The balcony according to the present invention may be configured such that its weight is supported by an upper and a lower attachment. The upper and lower attachments may be spaced apart so as to distribute the weight of the balcony across a vertical distance of the external wall of the construction. The vertical spacing between the upper and lower attachments produces a cantilever effect that directs a greater proportion of the force through the lower attachment, which provides a particularly stable attachment between the balcony and the construction.

It will be appreciated that the balcony may comprise more than two attachments without departing from the scope of the present invention. In embodiments, the balcony may comprise a third attachment which is arranged between the upper and lower attachments. The third attachment may define an intermediate, or middle, attachment which may be vertically spaced apart from both the upper and lower attachments, and may be configured to support at least a portion of the weight of the balcony. In this way, the weight of the balcony may be distributed in a substantially vertical direction across the upper, intermediate and lower attachments. The third attachment may comprise a latching mechanism which is similar to that which is described above in relation to the first or second attachments.

According to an exemplary arrangement, the balcony may be particularly suited for installing in steel frame buildings or buildings that have a hard external surface (i.e. a concrete external facia), which can provide multiple points from which to secure the first and second wall brackets.

The balcony may be fixed to a vertical structure of a building, such as a column of a building or a vertical truss of a steel framed building. In particular, the balcony may be fixed to and supported by a vertical structural member of such a building structure. Such structures may be strong enough to support the mounting of a balcony according to the present invention. This provides greater flexibility to architectural designers when determining where to position the balcony on the building.

The first balcony bracket may be substantially vertically aligned with the second balcony bracket. The first wall bracket may be substantially vertically aligned with the second wall bracket, so as to correspond with the respective first and second balcony brackets. The first and second wall brackets may define upper and lower wall brackets, respectively. In embodiments, the first balcony/wall brackets may be arranged at or near to an upper portion of the balcony and the second balcony/wall brackets may be arranged at or near to a lower portion of the balcony.

At least one, or each of the upper and lower balcony brackets may be adjustable in a vertical direction with respect to the balcony. The vertical adjustment of the upper and/or lower balcony brackets may be at least 5 millimetres, optionally at least 15 millimetres and/or up to 50 millimetres, optionally up to 20 millimetres. In this way, the upper and lower balcony brackets may be detachably configured in a number of vertical positions within the structure of the balcony.

The first and second attachments (i.e. the first and second balcony and wall brackets) may, together, define a first attachment assembly, and a second attachment assembly (comprising a further set of first and second attachments). The first and second attachment assemblies may each be arranged on a construction-facing side of the balcony. The first and second attachment assemblies may be spaced apart, in a horizontal direction, across the construction-facing side of the balcony. In this way, the first and second attachment assemblies may be arranged at a right and left side, respectively, of the balcony as viewed facing the construction. The first and second attachment assemblies may be arranged at distal lateral ends of the construction-facing side of the balcony.

There may be provided a third (or more) attachment assembly spaced apart (e.g. horizontally spaced apart) from the first and second attachment assemblies.

For example, the balcony may comprise at least one further attachment (e.g. a third attachment) which may be spaced apart, in a horizontal direction, from at least one of the first and second attachment assemblies. The further attachment may be arranged laterally between the first and second attachment assemblies. Such an arrangement is particularly beneficial for wider balconies because the further attachment may be configured to distribute the weight of the balcony across a width of the external wall of the construction. The further attachment may be arranged vertically below the first and/or second attachments of at least one of the first and second attachment assemblies. The further attachment may be arranged within, or near to, a floor assembly of the balcony. In embodiments, the further attachment is arranged between two balustrades of the balcony.

The latch assembly may define a first latch assembly. The balcony may comprise a second latch assembly which is configured to latch the second balcony bracket to the second wall bracket once the balcony has been secured to the construction by the first latch assembly.

The second latch assembly may comprise an upstanding protrusion arranged on an upper surface of either the second wall bracket or the second balcony bracket. The upstanding protrusion may be configured to engage with a latch of the latch assembly which is attached to the other of the second wall bracket and the second balcony bracket.

The upstanding protrusion may include a latch receiving surface which is arranged to face away from the other of the second wall bracket and the second balcony bracket, so that the latch can latch, or engage, against the latch receiving surface when it is arranged in a latched configuration. The latch may be configured to engage with the upstanding protrusion in order to prevent lateral movement between the second wall bracket and the second balcony bracket.

The latch of the second latch assembly may define a horizontal plate of the second balcony bracket or the second wall bracket. The latch may comprise an aperture which is configured to receive the upstanding protrusion which is arranged on the other of the second wall bracket and the second balcony bracket. The latch is configured, therefore, to fixedly attach the second balcony bracket to the second wall bracket, which thereby secures the balcony to the construction.

In an exemplary arrangement, the upstanding protrusion is arranged on an upper (e.g. uppermost) surface of the second wall bracket and the latch is arranged on the second balcony bracket. The latch receiving surface may be arranged to face away from the second balcony bracket, i.e., towards the construction, when in use, to engage with the aperture in the horizontal plate (i.e. the latch) when the latch is in the latched configuration.

The second latch assembly may comprise first and second members which are adjustably coupled together to allow relative movement therebetween. The second member may define the latch of the second latch assembly. The second member may comprise a threaded end which may be threadedly coupled to the first member to cause the latch to engage with the upstanding protrusion of the latch assembly.

The relative movement between the first and second members allows the upstanding protrusion of second latching assembly to urge the latch (i.e. the second member) from an unlatched configuration (i.e. prior to the balcony being mounted to the construction) to a latched configuration in which the upstanding protrusion is engaged to the latch of the second latch assembly. The relative movement between the first and second members enables the latch to be tightened against the upstanding protrusion of the second latch assembly, to prevent any lateral movement between the second wall bracket and the second balcony bracket. In this way, the second latch assembly provides a secondary fixation point between the balcony and the construction.

The first member of the second latch assembly may be pivotably attached by its lateral ends to the bracket (i.e. the second wall bracket or the second balcony bracket). The first member may be configured to pivot about a substantially horizontal pivot axis. The bore of the first member may be axially aligned perpendicular to a pivot axis of the first member, such that the second member is aligned in a perpendicular direction to the pivot axis of the first member.

The first member may be configured with a smooth bore (i.e. non-threaded bore) which is arranged to receive the threaded end of the second member. The bore may extend completely through the first member. A threaded bolt, or stud, of the second member may be configured to enter the threaded bore at one side of the first member and protrude from the opposite side of the first member. The threaded stud may be secured in position relative to the first member by a nut (e.g. a securing nut), or any other suitable fastening.

A distal end of the threaded stud (i.e. the end which is not engaged with the first member) may be fixedly attached (e.g. welded) to the horizontal plate which forms part of the latch of the second latch assembly. The threaded stud may be fixedly attached to an upper (e.g. uppermost) surface of the horizontal plate, and may extend in a perpendicular direction to connect with the first member at its threaded end.

The first member of the second latch assembly may comprise a yoke block, or pivot block, which may be supported by a pair of support structures of the bracket that are arranged either side of the lateral ends of the yoke block. The yoke block may comprise a pair of screws (e.g. countersunk screws) which connect the lateral ends of the yoke block to the support structures and thereby allow the yoke block to pivot, or rotate, about its pivot axis.

At least one, or each, of the first and second wall brackets may comprise a back plate, or base, which is configured to attach the wall bracket to the construction. At least one, or each, of the first and second wall brackets may comprise a latch receiving portion, or fin, which extends from the back plate.

The back plate may be substantially aligned with the external wall of the construction. Accordingly, the base may be configured to be substantially vertically aligned, when the balcony is arranged in the mounted position. The fin may be configured such that it is perpendicular to the base. The fin may be configured such that it extends from the base in a substantially horizontal direction, when the wall bracket is arranged on the construction.

The balcony may comprise a framework structure in which at least one, or each, of the first and second balcony brackets is housed. The balcony may comprise at least one aperture formed in the framework structure. At least one aperture may be configured so as to at least partially receive the first and/or second wall bracket to enable the respective latch assemblies to latch the brackets together. As such, the balcony may comprise a first aperture configured to at least partially receive the first wall bracket to enable it to be latched to the first balcony bracket. The balcony may comprise a second aperture configured to at least partially receive the second wall bracket to enable it to be latched to the second balcony bracket. In this way, the first and second apertures may define upper and lower apertures, respectively, of the balcony framework.

At least one, or each, aperture(s) may be configured such that the balcony can be mounted to the external surface of the construction by sliding the aperture, in a substantially horizontal direction onto the corresponding wall bracket(s).

The first and second balcony brackets may be housed within an elongate support of the balcony. The elongate support may form part of the framework of the balcony. The elongate support may comprise a post, or pillar, which may be axially aligned in a substantially vertical direction when the balcony is mounted to the construction. The elongate support may comprise a housing, or casing, which defines an internal volume in which the first and second balcony brackets may be housed. Hence, the elongate support may be substantially hollow along its longitudinal axis.

The elongate support may be arranged at, or near, to the construction-facing side of the balcony. The elongate support may be arranged at, or near, to a lateral side of the balcony. Accordingly, the elongate support may be arranged at, or near, to the corner between the lateral and construction-facing sides of the balcony.

The elongate support may comprise an inner wall and an outer wall which are arranged, when in use, to be parallel with the external wall of the construction to which the balcony is to be attached. The outer wall may define at least part of the construction-facing side of the balcony. The elongate support may further comprise two lateral side walls which extend between the inner and outer walls. The casing of the elongate support may comprise a rectangular cross section.

At least one, or each, of the first and second apertures, as described above, may be arranged in the inner wall of the elongate support. At least one, or each, of the apertures may be formed by cutting a partial outline of the aperture to form a cut-out, or flap, of material which is connected on one side to the remainder of the framework wall. The flap may be bent inwardly (i.e. towards the internal volume of the elongate support) so as to form an internal structural element of the elongate support. The apertures may be cut using a laser cutter. Alternatively, the apertures may be formed by a punching process.

The latch support of the latch assembly, as described above, may be attached at one end to the internal structural element of the elongate support, and another end of the latch support may be configured to support the latch in its unlatched configuration. In this way, the balcony structure provides structural support for the latch.

The balcony may comprise a first and a second elongate support, which may be arranged, respectively, at a first and a second position on the construction-facing side of the balcony. Each of the first and second elongate supports may comprise a first and second attachment, as described according to the preceding paragraphs. The first and second elongate supports may be arranged, respectively, on a left and a right side of the balcony as viewed facing the construction.

The balcony may comprise a cassette which defines a floor section of the balcony. The cassette may comprise a plurality of parallel rafters arranged between an upper and lower floor panel. The rafters may be arranged to extend longitudinally away from the building when in use.

The balcony may comprise a plurality of balustrade elements arranged on top of the balcony cassette. The balustrade elements may comprise a plurality of balustrade columns and/or panels. It will be appreciated that the panels and/or balustrade columns may be formed of a number of different construction types. The balcony may comprise a handrail arranged on top of the plurality of balustrade elements.

The balustrade elements may comprise a pair of side panels arranged at the lateral sides of the balcony. Each side panel may be configured to provide structural support to the first and second attachments arranged at each side of the balcony. In particular, the side panel may transmit cantilever forces associated with the suspended mass of the balcony to the upper attachments. In this way, the side panel may define a stress skin of the balcony.

Alternatively, or additionally, the balcony may comprise a bracing element which is coupled between an upper-inner portion of the balcony and a lower-outer portion of the balcony. The bracing element may take the form of a tie wire or a rigid strut, for example. The bracing element may be coupled, at one end, to an upper region of an elongate support and at another end to a cantilevered portion of the balcony cassette.

A second aspect of the present invention provides a balcony system comprising at least one balcony according to the first aspect, together with a plurality of wall brackets.

At least one, or each, of the first and second wall brackets may be constructed from one or more steel plates. In situations where a wall bracket is formed of two or more steel plates, they may be welded together to form a rigid construction. A first plate may be provided with mounting holes through which bolts can pass to secure the wall bracket to a construction (e.g. a building structure). In this way, the first plate may define the base of that wall bracket.

The first plate may be provided with four mounting holes, although it will be appreciated that more or fewer mounting holes may be provided depending on the size of the wall bracket and the size of balcony to be supported. As such, the first plate may be arranged in parallel with an external wall of the construction to which the balcony is to be attached. The external wall of the construction may define a substantially vertical mounting surface. In alternative arrangements, the balcony may be configured to be attached to a sloping external wall. In particular, at least one of the side panels of the balcony may be configured (i.e. shaped) to accommodate sloping walls. The at least one shaped side panel may be attached to the sloping side wall of the building by an upper and a lower attachment, as described above.

A second plate of the wall bracket may be arranged substantially perpendicular to the first plate and may be upstanding from the first plate so as to define a balcony supporting portion of the wall bracket. The wall bracket may be configured such that, when in use, the second plate is arranged substantially perpendicular to the external wall of the construction and is configured to extend in a substantially horizontal direction. The second plate may be arranged such that it is aligned perpendicular to a vertical plane such that the balcony may be brought to rest on an edge of the second plate. In this way, the balcony may be supported by an upper (e.g. an uppermost) surface of the wall bracket.

A third aspect of the present invention provides a method of attaching a balcony to a building or other construction. The method comprises the steps of fitting a plurality of wall brackets to the construction; and attaching a balcony having a plurality of balcony brackets on one side of the balcony which are arranged to engage with the plurality of wall brackets, including a first balcony bracket arranged to engage with a first wall bracket and a second balcony bracket arranged to engage with a second wall bracket, so as to cause the weight of the balcony to be supported by the construction when the balcony is arranged in a mounted position. The first balcony bracket is spaced apart from the second balcony bracket in a substantially vertical direction, and wherein the balcony comprises a latch assembly which is configured, when the balcony is arranged in the mounted position, to securely attach the balcony to the construction. The method step of attaching the balcony comprises moving the first wall bracket and the first balcony bracket together to cause the latch assembly to latch the first wall bracket to the first balcony bracket; and adjusting the latch assembly to tighten the attachment between the wall bracket and the balcony bracket.

The method may comprise urging the latch assembly from the unlatched configuration to the latched configuration as the balcony is moved into the mounted position.

Either the first wall bracket or the first balcony bracket may comprise a first member and a second member which are adjustably coupled to each other to allow relative movement therebetween. The second member may comprise the latch and the first member may be attached to the bracket. The method of attaching the balcony may comprise, once the balcony is arranged in the mounted position, moving the first and second members relative to each other to apply a tensile force between the latch and the other of the first wall bracket and the first balcony bracket in order so as to tighten the latch against the other of the first wall and balcony brackets. This adjustment can be easily performed by a worker who is positioned in the construction, and who can reach out to the balcony, which has been safely latched to the construction by the latch assembly.

Either the second wall bracket or the second balcony bracket may comprise a first member and a second member which are adjustably coupled to each other to allow relative movement therebetween. The second member may comprise the latch and the first member may be attached to the bracket. The method of attaching the balcony may comprise, once the balcony is arranged in the mounted position and once the first latching assembly has been tightened as described above, moving the second member relative to first member to apply a compressive force between the second member (i.e. the latch) to tighten the second member against the other of the second wall and balcony brackets.

The method of attaching may include suspending the balcony such that it is substantially vertically aligned with the first and second wall brackets and sliding at least one aperture over the corresponding wall bracket(s).

BRIEF DESCRIPTION OF THE DRAWINGS

Embodiments of the invention will now be described by way of example with reference to the accompanying drawings in which.

DETAILED DESCRIPTION

Aspects and embodiments of the present disclosure will now be discussed with reference to the accompanying figures. Further aspects and embodiments will be apparent to those skilled in the art.

Figure 1:
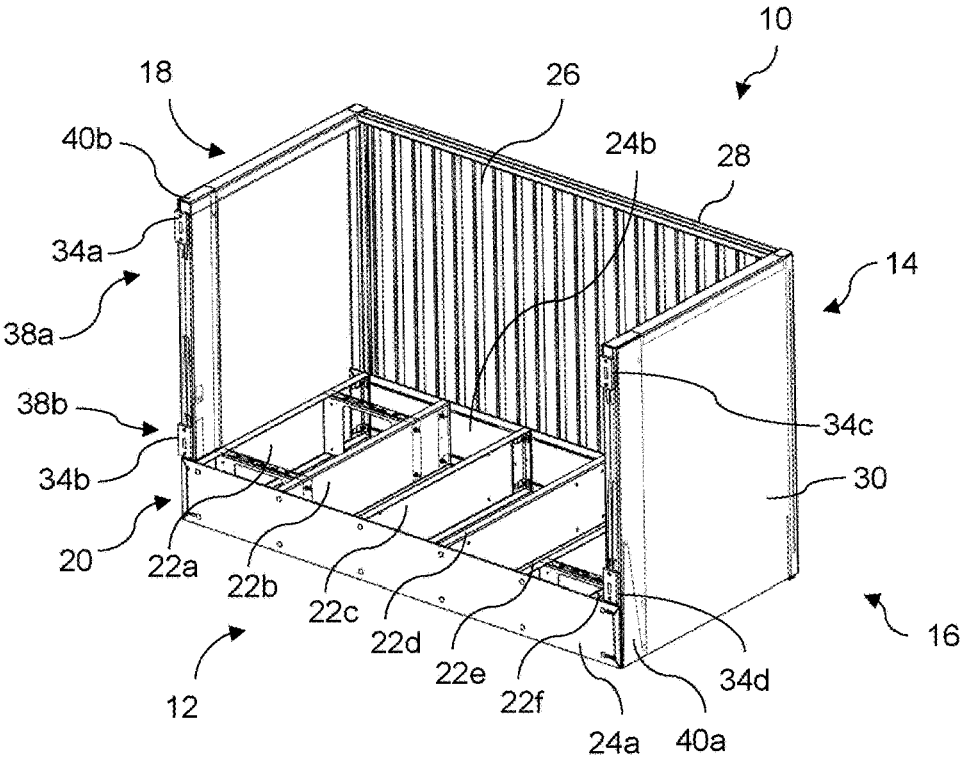
FIG. 1 shows a perspective view of a balcony system according to an embodiment of the present invention.

FIG. 1 shows a perspective view of a balcony 10, along with corresponding wall brackets 34*a*-34*d*, according to a first embodiment of the present invention. The balcony is arranged in an upright orientation as it would be when mounted to a construction (not shown), or building.

The balcony 10 has an inner and an outer side 12, 14 arranged to face towards and away from the building, respectively, when the balcony 10 is in a mounted position. It will be appreciated that when the balcony is in use, the outer side 14 is substantially cantilevered from the building, whereas the inner side 12 is arranged adjacent to an external wall of the building. The balcony 10 also includes left and right lateral sides 16, 18, as viewed facing the building.

A plurality of wall brackets 34*a*, 34*b*, 34*c*, 34*d* and a plurality of balcony brackets 36*a*, 36*b* are arranged on a construction-facing side 12 of the balcony 10. The right and left sides 18, 16 of the balcony 10 are each arranged with an upper wall bracket 34*a*, 34*c* and a lower wall bracket 34*b*, 34*d*, respectively. Each of the four wall brackets is coupled to a corresponding balcony bracket so as to define four attachments, or attachment points, between the balcony 10 and the building.

In particular, the wall brackets are arranged to be attached to the external wall of a building and the balcony brackets are arranged to be attached to the balcony 10. Each wall bracket is located on the external wall of the building so as to engage with the corresponding balcony bracket. Accordingly, when the balcony 10 is arranged in its mounted positon, the plurality of wall and balcony brackets are coupled together such that the weight of the balcony 10 is supported by the building. The balcony 10 also comprises a series of latch assemblies which are configured to latch the wall brackets to the balcony brackets in order to secure the balcony 10 to the building, as will be explained in more detail below.

A typical balcony 10 is shown in FIG. 1 having plan view area dimensions of 3m×1.2m. The balcony 10 includes a floor section 20 which is of an open lattice type structure, in this case manufactured from folded 3 mm aluminium sheet. The floor section 20 has two transversely arranged panels 24*a*, 24*b* forming the inner and outer sides of the floor frame when viewed facing the building. A plurality of parallel rafters 22*a*, 22*b*, 22*c*, 22*d*, 22*e*, 22*f* extend, in a perpendicular direction, between the two transversely arranged panels 24*a*, 24*b*. The inner and outer sides and the rafters 22*a-f* are arranged between upper and lower floor panels. Only the frame of the floor section 20 of the balcony 10 is shown in FIG. 1, as the deck that would normally form the upper floor panel has been omitted to show the internal structure of the floor section 20.

The balcony 10 also includes a plurality of balustrade columns 26 arranged on top of the floor section 20. The balustrade columns 24 are arranged along the outer side 14 of the balcony 10. A handrail 28 is provided on top of the plurality of balustrade columns 24. The balcony 10 comprises a pair of side panels 30 arranged on the left and right sides 16, 18 of the balcony 10.

Each side panel 30 is configured to provide structural support to the balcony 10 by transmitting cantilever forces associated with the suspended mass of the balcony 10 to an upper attachment between the balcony and the building. In this way, the side panels 30 define a stress skin of the balcony 10. In alternative embodiments (not shown) there may be a reinforcing construction formed at the interior of each side panel to transmit said cantilever forces.

Figure 2:
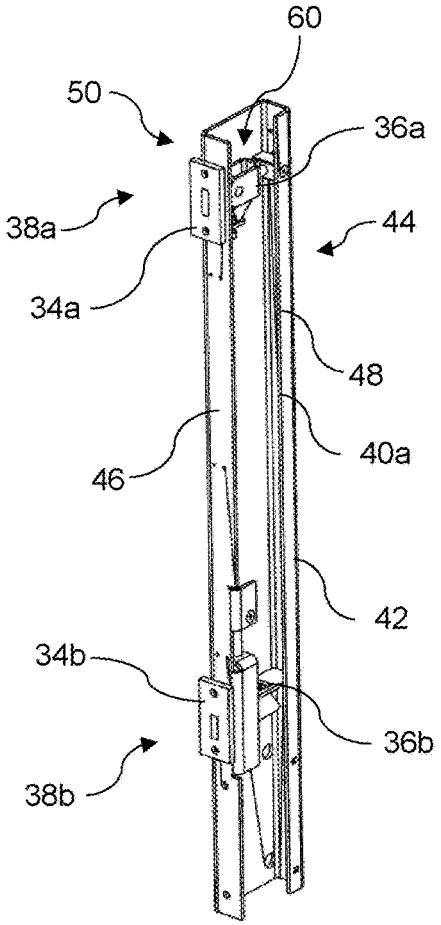
FIG. 2 shows a perspective view of a part of the framework of the balcony system shown in FIG. 1.

With reference to FIG. 2, a first wall bracket 34*a* and a first balcony bracket 36*a* define an upper attachment 38*a* of the balcony 10. Similarly, a second wall bracket 34*b* and a second balcony bracket 36*b* define a lower attachment 38*b* of the balcony 10. Accordingly, the first and second brackets define upper and lower brackets, respectively.

The upper and lower attachments 38*a*, 38*b* are spaced apart in a vertical direction to distribute the weight of the balcony across the external wall of the building. The vertical separation between the upper and lower attachments 38*a*, 38*b* also produces a cantilever effect that directs a greater proportion of the force through the lower attachment 38*b*, which thereby provides a stable coupling to the building.

The upper and lower attachments 38*a*, 38*b*, together, define a first attachment assembly of the balcony 10. The balcony 10 according to the present invention comprises two attachment assemblies (i.e. one arranged on each side of the balcony 10). However, it will be appreciated that the balcony 10 may comprise any number of attachment assemblies, depending on the specific installation, for example depending on the configuration and construction of the balcony 10, the weight and moment of the balcony 10 to be supported and the dimensions of the wall brackets.

The upper and lower attachments 38*a*, 38*b* are mounted within respective elongate supports 40*a*, 40*b*, or posts, which form part of the framework of the balcony 10. The elongate supports 40*a*, 40*b* are arranged at the building-facing side 12 of the balcony 10 such that the upper and lower attachments 38*a*, 38*b* can be readily attached to the building.

FIG. 2 shows a perspective view of the elongate support 40*a* in isolation from the rest of the structure of the balcony 10. The elongate support 40*a* is a hollow structure having a rectangular cross-section, and is arranged, when in use, to be axially aligned with the external wall of the building, and a height direction of the balcony 10.

The elongate support 40*a* has a housing 42 which includes an inner wall 44 and an outer wall 46 which are arranged, when in use, to be parallel with the external wall of the building. As such, the outer wall 46 defines at least part of the construction-facing side 12 of the balcony 10. The elongate support 40*a* also includes two lateral side walls 48, 50 which extend at least partially between the inner and outer walls 44, 46. Accordingly, the housing 42 of the elongate support 40*a* defines an internal volume in which the upper and lower attachments 38*a*, 38*b* are arranged.

The elongate supports 40*a*, 40*b* may be formed from a single sheet of steel which is folded, or bent, in order to form the walls of the housing 42. The base of each of the elongate supports 40*a*, 40*b* is welded to the floor section 20 of the balcony 10. In addition, the inner wall 44 of the housing 42 of each elongate support is welded to the corresponding side panel of the balcony framework. According to an alternative exemplary arrangement, the elongate supports 40*a*, 40*b* may be fixedly attached to the framework of the balcony 10 by any suitable fastening means, such as rivets, bolts or screws, as would be appreciated by a person having ordinary skill in the art.

As described above, the balcony 10 comprises a set of latch assemblies which are configured to latch together the respective pairs of wall and balcony brackets. A first latch assembly 60 is configured, when the balcony 10 is arranged in the mounted position, to latch the upper balcony bracket 36*a* to the upper wall bracket 34*a*, as shown in FIG. 2. A second latch assembly 62 is provided to latch the lower wall bracket 34*b* to the lower balcony bracket 36*b*. Accordingly, the first and second latch assemblies define upper and lower latch assemblies, respectively.

The upper and lower latch assemblies 60, 62 are configured differently, as will be described in more detail below. In general, the upper latch assembly 60 is configured to simultaneously latch the balcony 10 to the building as the balcony is moved into its mounted position. The lower latch assembly 62 is then configured, once the upper latch assembly 60 has latched the upper wall and balcony brackets together, in order to further secure the balcony 10 to the building (i.e. once the balcony 10 is already arranged in its mounted position). In this way, the upper latch assembly 60 provides a semi-permanent attachment between the balcony 10 and the building, and the lower latch assembly 62 provides a more permanent attachment which provides strengthening support to the upper latch assembly 60.

Figure 5:
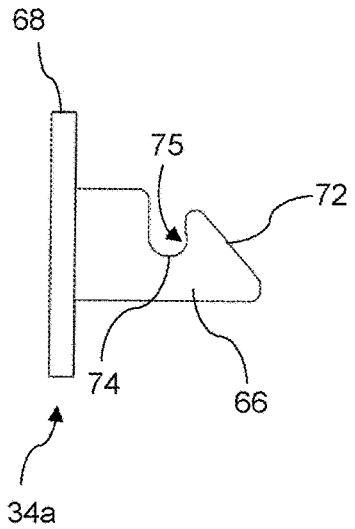
FIG. 5 shows a side-on view of a first wall bracket of the balcony system shown in FIG. 1.
Figure 6:
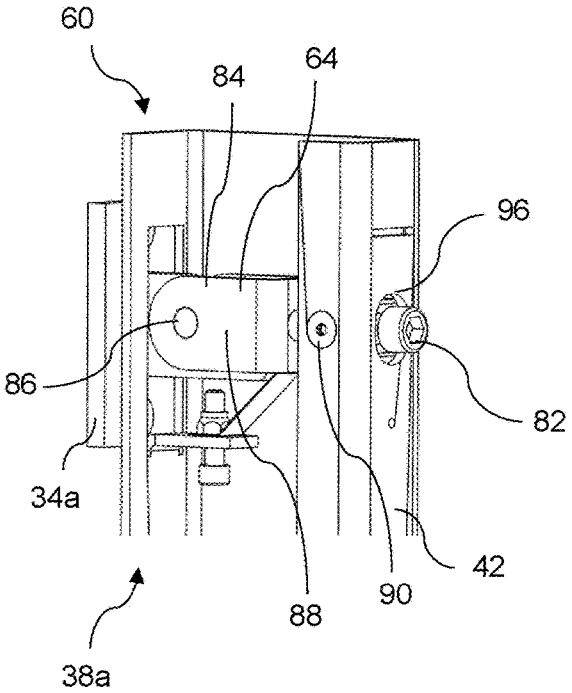
Figure 7:
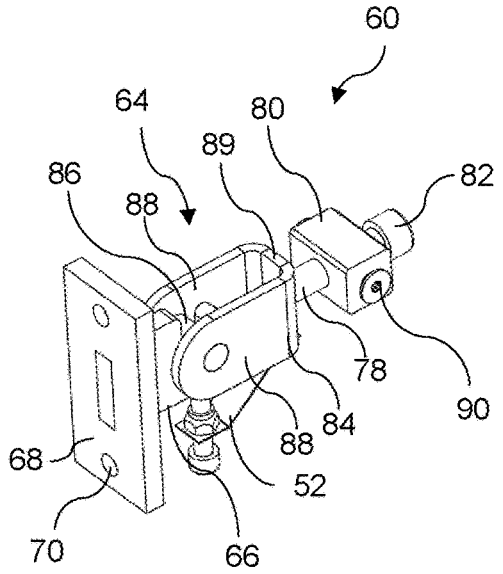

The upper latch assembly 60 will now be described with particular reference to FIGS. 3 to 6, which show close-up perspective views of the upper attachment 38*a* arranged within the elongate support 40*a*. Reference is also made to FIG. 7 which illustrates the upper latch assembly 60 in isolation from the rest of the balcony framework.

As described above, the upper attachment 38*a* includes the upper wall bracket 34*a* and the upper balcony bracket 36*a*. The upper balcony bracket 36*a* forms a latch 64 of the upper latch assembly 60, which is received by a hook shaped latch receiving portion 66 of the upper wall bracket 34*a*.

Figure 3:
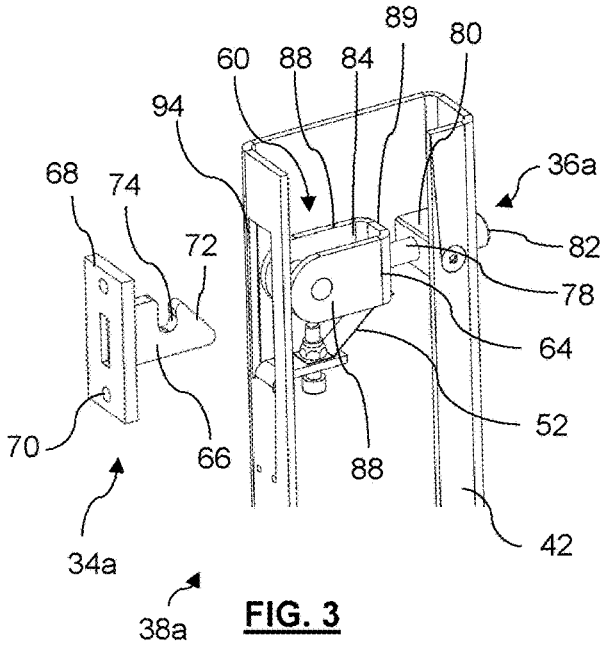
FIGS. 3, 4, 6 and 7 show perspective views of a first latch assembly of the balcony system shown in FIG. 1.
Figure 4:
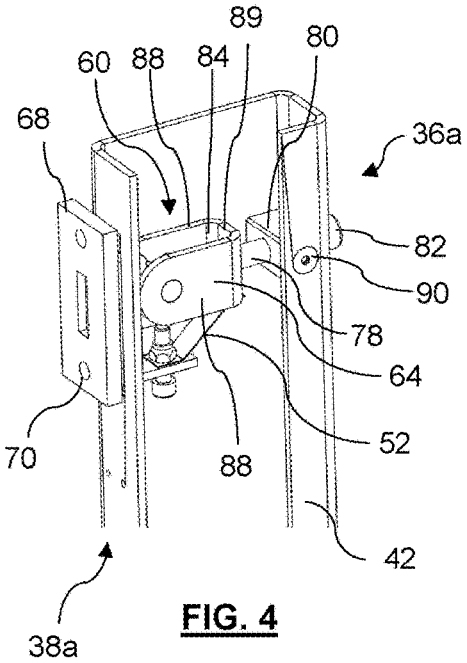

The latch 64 is configured to be movable from an unlatched configuration to a latched configuration as the balcony 10 is maneuvered into its mounted position. In this way, the unlatched configuration defines the arrangement, or position, of the latch 64 before the balcony is moved into the mounted position, as shown in FIG. 3. Accordingly, the latched configuration defines the arrangement of the latch 64 once, or after, the balcony is arranged in the mounted position, as shown in FIG. 4. It will be appreciated, therefore, that it is the movement of the balcony 10 towards the construction which causes the latch 64 to move from the unlatched to the latched configuration, as the upper balcony bracket 36*a* is engaged with the upper wall bracket 34*a* (i.e. moving from the configuration as shown in FIG. 3 to that which is illustrated in FIG. 4).

The upper wall bracket 34*a* includes a back plate 68 which is arranged to be bolted to the building. Accordingly, the back plate 68 is substantially aligned with the external wall of the construction. The latch receiving portion 66 is arranged to extend in a substantially perpendicular direction from the back plate 68, as shown in FIG. 3.

The upper wall bracket 34*a* is made from steel plates welded together to form a rigid construction. For example, the back plate 68 is typically sized 100 mm wide×150 mm high×12 mm thick. The latch receiving portion 66 projects from the back plate 68 to form a fin, as shown in FIG. 3. The latch receiving portion 66 is a piece of 75 mm wide×50 mm high×12 mm thick stainless steel which is welded to the back plate 68 to form a hook onto which the latch 64 can be engaged. It will be appreciated that the upper wall brackets may be formed of any structural material which is suitably configured to support the weight of the balcony, as dictated by the requirements of the balcony system.

The back plate 68 is provided with mounting holes 70 through which bolts can pass to secure the wall bracket 34*a* to the building. The upper wall bracket 34*a* is shown with two mounting holes, but it will be appreciated that more or fewer mounting holes may be provided depending on the size of the wall bracket and the size of balcony to be supported.

The latch receiving portion 66 is provided with a tapered leading end 72, which is arranged to face the upper balcony bracket 36*a*, when the balcony is being moved into the mounted position. As such the tapered leading end 72 is configured, when the balcony 10 is being moved into the mounted position, to urge the latch 64 from its unlatched configuration to the latched configuration. In particular, the tapered leading end 72 provides a ramp which guides the latch 64 up and into the hook-shaped end of the latch receiving portion 66.

The latch receiving portion 66 is provided with a concave depression 74 which is arranged rearward of the tapered leading end 72, and on an upper surface of the wall bracket 34*a*. As such, the concave depression 74 is located such that it will receive the latch 64 as it is guided up and onto the top of the latch receiving portion 66 by its tapered leading end 72. Accordingly, the concave depression is configured (i.e. shaped or dimensioned) to receive the latch 64 when it is arranged in the latched configuration. Both the tapered leading end 72 and the concave portion 74 are cut out of (for example using a plasma cutter) from the latch receiving portion.

The concave depression 74 includes a retaining wall which is configured to substantially prevent vertical movement of the latch 64 once the latch 64 is received by the latch receiving portion 66. With particular reference to FIG. 5, the retaining wall includes a curved surface 75 which is configured to match a corresponding portion of an outer surface of the latch 64, so that the latch 64 is receiving snugly within the concave depression. Furthermore, the curved surface 75 is arranged, when in use, to face substantially away from the latch 64 so that the latch 64 can hook against the curved surface when the latch 64 is received within the concave depression 74.

The latch 64 includes a threaded stud 78 which is coupled, at one end, to a yoke 84. A distal end of the threaded stud 78 (i.e. the end which is not coupled to the yoke 84) is adjustably coupled to a yoke block 80, which is pivotably mounted to the housing 42 of the balcony 10 to allow the latch 64 to move between the latched configuration and the unlatched configuration, when in use.

The yoke 84 includes a yoke pin 86 which is configured to engage with the latch receiving portion 66 of the upper latch assembly 60, when the latch is arranged in the latched configuration. The yoke pin 86 extends between two side supports 88 which define a substantially U-shaped member of the yoke 84, as shown in FIGS. 3, 4 and 7. A connecting wall 89 is provided to join together the two side supports 88 at a distal end of the yoke 84 (i.e. the end which does not comprise the yoke pin 86). The connecting wall 89 is arranged substantially perpendicular to the side supports 88. In this way, the yoke 84 defines a folded fork comprising two projections (i.e. the two side supports 88) which, when the latch 64 is engaged with the upper wall bracket 34*a*, are configured to extend either side of the latch receiving portion 66.

The yoke 84 is configured such that the yoke pin 86 is arranged in a substantially horizontal alignment. This ensures that the yoke pin 86 is able to engage with the tapered leading end 72 of the latch receiving portion 66, which then guides the yoke pin 86 into the concave depression 74 of the upper latch assembly 60 as the balcony 10 is moved into its mounted position.

The yoke block 80 is pivotably attached by its lateral ends to the upper balcony bracket 36*a*. A pair of countersunk screws 90 couple the lateral ends of the yoke block 80 to the walls of the elongate support 42 to define a substantially horizontal pivot axis.

The threaded stud 78 is received within a bore of the yoke block 80. The bore is axially aligned in a perpendicular direction to the horizontal pivot axis of the yoke block 80. Accordingly, the threaded stud 78 is also axially aligned in a perpendicular direction to the horizontal pivot axis of the yoke block 80, which enables the latch 64 to be rotated in a substantially vertical plane. This pivoting movement of threaded stud 78 about the horizontal pivot axis enables the latch 64 to be raised and lowered in order to engage with the latch receiving portion 66 of the upper wall bracket 34*a* (i.e. by moving the latch between the unlatched and latched configurations).

Accordingly, the yoke block 84 is configured such that its horizontal pivot axis is arranged to be substantially parallel with the external wall of the building, and the vertical latch rotation plane is arranged such that it is substantially perpendicular to the external wall of the building.

As described above, the yoke block 80 is arranged to receive the threaded stud 78 and to allow relative movement therebetween. To achieve this, the axial bore defines a clearance hole that has a diameter which is greater than that of the threaded stud 78. The axial bore extends completely though the yoke block 80 such that the stud 78 is configured to enter the axial bore at one side and protrude out from the opposite side, as is shown in FIGS. 6 and 7.

The threaded stud 78 is secured in position relative to the yoke block 80 by a latch adjustment head 82 and a securing nut (not shown) arranged either side of the yoke block 80. The securing nut is a locking half nut which is arranged on the threaded stud 78, between the yoke 84 and the yoke block 80, and is configured to lock up against the yoke block 80 to secure the latch 64 in place once the latch's correct position is achieved (e.g. once the latch 64 has been tightened against the wall bracket 34*a*).

The yoke 84 is adjustably coupled to the threaded stud 78 at its distal end (i.e. at an end of the threaded stud 78 which is distanced away from the yoke block 80). To achieve this, a threaded bore is provided in a wall of the yoke 84 to receive the threaded stud 78. The thread of the threaded bore is configured to cooperate with the thread of the threaded stud 78. The threaded bore is arranged in the connecting wall 89 of the yoke 84 which joins together the two side supports 88. A clearance hole is arranged in the connecting wall 89 into which a threaded nut is welded in order to provide the threaded bore. Alternatively, the threaded bore may be tapped directly into the connecting wall 89.

The threaded coupling between the yoke 84 and the threaded stud 78 is such that a rotation of the latch adjustment head 82 leads to a rotation of the threaded stud 78 relative to the threaded bore in the wall of the yoke 84, which in turn causes the yoke 84 to be pulled towards the yoke block 80. In this way, the yoke 84 is rotatably tightened against the latch receiving portion 66 of the upper wall bracket 34*a*.

As described above, the threaded stud 78 is configured to enable the threaded coupling to be rotatably adjusted to allow tightening of the upper latch assembly 60. The threaded stud 78 is a 75 mm bolt having a M16 head, which defines the latch adjustment head 82. An aperture 96 is formed on an inner wall 44 of the elongate support 40*a* to allow access to the latch adjustment head 82, as shown in FIG. 6.

The threaded coupling between the threaded stud 78 and yoke block 80 means that, once the latch 64 is arranged in the latched configuration, it can be tightened against the latch receiving portion 66 of the upper wall bracket 34*a* by adjusting the coupling between the threaded stud 78 and the threaded bore of the yoke 84. As a result, the balcony 10 can be pulled closer to the external wall of the building, thereby securing it in its mounted position.

The threaded coupling is particularly advantageous because it enables a worker to make fine adjustments when tightening the latch 64 against the latch receiving portion 66 of the upper wall bracket 34*a*.

The yoke block 80 is attached to the upper balcony bracket 36*a* at a location which is distanced away from the construction-facing side 12 of the balcony 10. The latch 64 is, therefore, configured to extend from the yoke block 80, in a substantially horizontal direction (e.g. towards the building), when the upper latch assembly 60 is arranged in the unlatched configuration. In this way, the latch 64 is positioned for engagement with the tapered leading end 72 of the upper wall bracket 34*a*, and can be guided into the latched configuration as the balcony 10 is moved into the mounted position.

The upper latch assembly 60 also includes a latch support 52 which is configured to support the latch 64 in the unlatched configuration. The latch support 52 comprises a thin strip of steel which is mounted below the latch 64 and is coupled, at one end, to the housing 42 of the elongate support 40*a*. A distal end of the latch support 52 is then configured to extend upwardly towards the yoke 84 which is then supported by the latch support 52 in its unlatched configuration. In this way, the latch support 52 ensures that the latch is ready to be moved from the unlatched configuration to the latched configuration, as the balcony 10 is moved into its mounted position.

As is clear from FIG. 3, the upper balcony bracket 36*a* is substantially housed within the elongate support 40*a*. As such, an aperture 94 is formed in the construction-facing side 12 of the housing 42 to enable the upper latch assembly 60 to latch the upper wall and balcony brackets 34*a*, 36*a* together. Accordingly, the aperture 94 is configured such that the balcony 10 can be mounted to the external wall of the building by sliding the aperture onto the corresponding wall bracket 34*a*.

The aperture 94 is formed by laser cutting, or punching, a partial outline of the aperture 94 to define a cut-out, or flap, of material. The flap is bent from its base towards the interior of the elongate support 40*a* so as to form an internal structural element which is connected at one side to the remainder of the elongate support 40*a*. The latch support 52 of the upper latch assembly 60, as described above, is bolted at one end to the internal structural element, as shown in FIGS. 3, 4 and 6.

Figure 8:
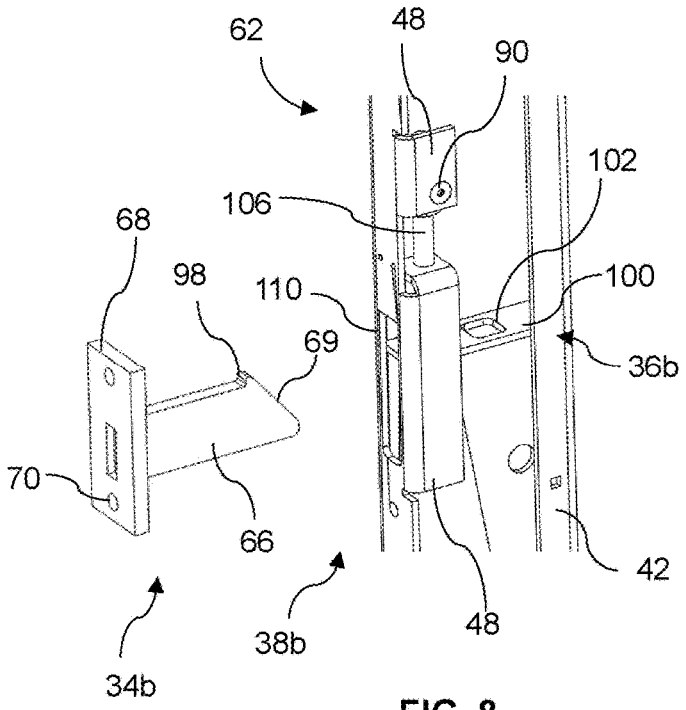
FIGS. 8 to 10 show perspective views of a second latch assembly of the balcony system shown in FIG. 1.
Figure 9:
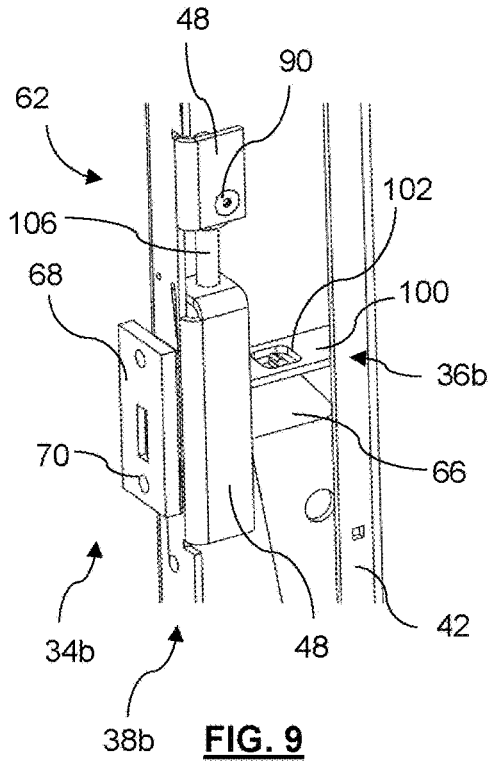
Figure 10:
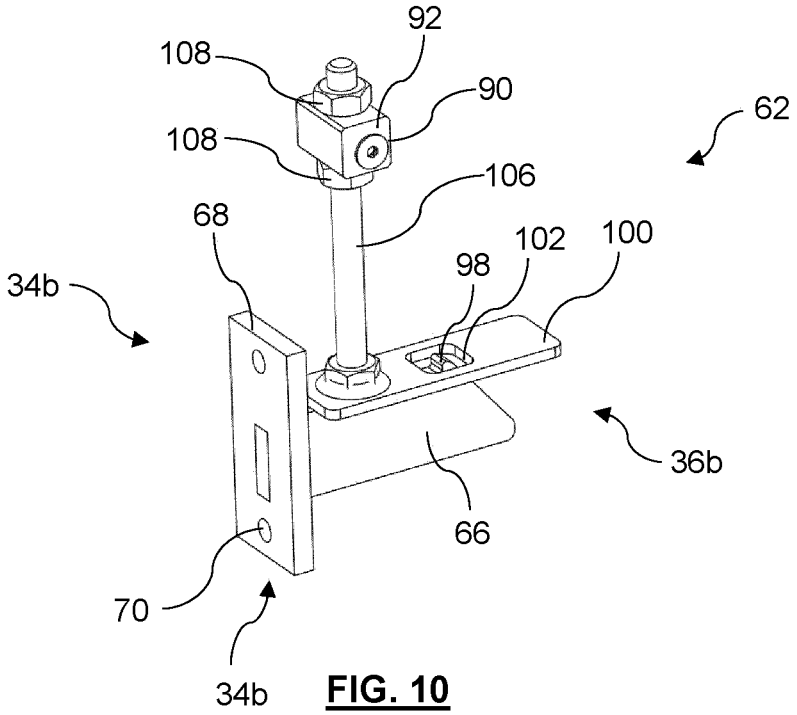

The lower latch assembly 62 will now be described with particular reference to FIGS. 8 and 9, which are close-up perspective views of the lower attachment 38*b* arranged within the elongate support 40*a*. Reference is also made to FIG. 10 which illustrates the lower latch assembly 62 in isolation from the rest of the balcony framework.

As described above, the lower latch assembly 62 is configured to secure the lower balcony bracket 36*b* to the lower wall bracket 34*b*, once the balcony 10 has been secured to the building by the upper latch assembly 60.

The lower latch assembly 62 includes an upstanding protrusion 98 arranged on an upper surface of the lower wall bracket 34*b*. The upstanding protrusion 98 is configured to engage with a latch 100 of the lower latch assembly 62 which is attached to balcony 10, as will be described in more detail below.

The lower wall bracket 34*b* includes a back plate 68 which is arranged to be bolted to the building. Similar to the upper wall bracket 34*a*, a latch receiving portion 66 is arranged to extend in a substantially perpendicular direction from the back plate 68. The latch receiving portion 66 is also provided with a tapered leading end 104 which is configured to guide the latch 100 up and over the upstanding protrusion 98.

The lower wall bracket 34*b* is made from steel plates welded together to form a rigid construction. The back plate 68 has the similar dimensions to the upper wall bracket 34*a*, and is provided with mounting holes 70 through which bolts can pass to secure the wall bracket 34*b* to the building. However, the latch receiving portion 66 of the lower wall bracket 34*b* may be significantly wider than that of the upper wall bracket 34*a*. For example, the latch receiving portion 66 as shown in FIG. 10, is configured such that it projects from the back plate 68 to form a fin having dimensions of 150 mm wide×50 mm high×12 mm. In this way, the lower wall bracket 34*b* is configured to support a greater proportion of the balcony's weight. Alternatively, the latch receiving portion of the lower wall bracket may be configured to have a width that is equal or less than that of the latch receiving portion of the upper bracket.

The upstanding protrusion 98 includes a latch receiving surface which is arranged to face substantially away the lower balcony bracket 36*b*, so that the latch 100 can be latched against the latch receiving surface when the latch assembly 62 is arranged in a latched configuration. The latch 100 is configured to engage with the upstanding protrusion and thereby prevent lateral movement between the lower wall bracket 34*b* and the lower balcony bracket 36*b*.

An aperture 110 is formed in the construction-facing side 12 of the housing 42 to enable the lower latch assembly 62 to latch the lower wall and balcony brackets 34*b*, 36*b* together. Accordingly, the aperture 110 is configured such that the balcony 10 can be mounted to the external wall of the building by sliding the aperture 110 onto the corresponding wall bracket 34*b*. The lower latch assembly 62 is partially enclosed by a section of the lateral side wall 48 of the elongate support 40*a*, as shown in FIGS. 8 and 9.

The latch 100 comprises a horizontal plate having an aperture 102 which is configured to receive the upstanding protrusion of the lower wall bracket 34*b*. The aperture 102 is configured to attach the lower balcony bracket 36*b* to the lower wall bracket 34*b*, which thereby secures the balcony 10 to the building.

The lower latch assembly 62 includes a yoke block 92 which is adjustably coupled to the latch 100 to allow relative movement therebetween, as shown in FIG. 10. The latch 100 is suspended from a threaded stud 106 which extends between the latch 100 and the yoke block 92, and is received within a bore of the yoke block 92. A distal end of the threaded stud 106 (i.e. the end which is not received by the yoke block 92) is fixedly attached (e.g. welded) to an upper surface of the horizontal plate which forms the latch 100.

The yoke block 92 is pivotably attached by the balcony 10 to allow latch 100 to move slightly relative to the balcony 10 as it engages with the lower wall bracket 34*b*. In particular, the yoke block 92 is provided with a pair of screws 90 which connect the lateral ends of the yoke block 92 to the lateral side walls 48, 50 of the elongate support 40*a* to allow the yoke block 92 to pivot, or rotate, about a substantially horizontal pivot axis. The left lateral side wall 48 is formed by a section of the housing 42 of the elongate support 40*a* which has been bent along a vertical fold line to provide a lateral support for the yoke block 92.

The bore of the yoke block 92 is then axially aligned in a perpendicular direction to the pivot axis of the yoke block 92, such that the threaded stud 106 is also aligned in a perpendicular direction to the horizontal pivot axis. When in use, the threaded stud 106 is arranged to hang in a substantially vertical direction, as shown in FIGS. 8 to 10.

The yoke block 92 of the lower latch assembly 62 is configured with a smooth bore (i.e. non-threaded bore) which extends completely therethrough. The threaded stud 106 is arranged to protrude through the bore of the yoke block 92 and is secured in position by a pair of nuts 108, which are arranged either side of the yoke block 92. The nuts 108 allow the height of the horizontal plate (i.e. the latch 100) to be adjusted relative to the balcony 10 and the lower wall bracket 34*b*.

During installation of the balcony 10, the relative movement between the latch 100 and the yoke block 92 allows the upstanding protrusion 98 to slightly elevate the latch 100, as the balcony is arranged into its mounted position. This enables the upstanding protrusion to be received within the aperture 102. The adjustment nuts 108 then allow the latch 100 to be tightened against the lower wall bracket 34*b*. Accordingly, the underside of the latch 100 is brought into contact with the upper surface of the latch receiving portion 66 in order to support the weight of the balcony 10.

The lower latch assembly 62 is arranged to further secure the balcony 10 to the building, once the balcony has been latched in place by the upper latch assembly 60. In particular, the upstanding protrusion 98 prevents any lateral movement between the lower wall bracket 34*b* and the lower balcony bracket 36*b*. In this way, the lower latch assembly 62 provides a secondary fixation point between the balcony 10 and the building.

An exemplary method of installing the balcony 10 will now be described with reference to FIG. 11, which illustrates illustrates a flow chart of the corresponding method steps.

The method 200 commences with a first method step 202 which involves fitting a plurality of wall brackets to the external wall of a building. The wall brackets are arranged so as to correspond to the positions of the matching balcony brackets when the balcony is offered up to the building. In particular, the method 202 comprises arranging a plurality of upper and lower wall brackets 34*a*, 34*b* to the building, such that they are vertically aligned with each other.

The wall brackets can be connected to a concrete, or steel, frame of the building whilst the exterior brickwork (or other cladding material) can be built around the wall bracket, thereby potentially hiding or disguising the connection of the wall brackets to the building.

The method then proceeds to a second method step 204 in which the balcony 10 is attached to the building. This involves suspending the balcony 10 from a crane such that it is substantially vertically aligned with the upper and lower wall brackets 34*a*, 34*b*. The balcony 10 is then maneuvered in a substantially horizontal direction, towards the external wall of the building, which causes the apertures 94, 110 to slide over the corresponding wall brackets.

During this method step 204, the wall brackets 34*a*, 34*b* are engaged with the balcony brackets 36*a*, 36*b* and the upper latch assembly 60 engages the upper balcony bracket 36*a* to the upper wall bracket 34*a*, thereby securing the balcony 10 to the building. This process is (compared to the prior art processes described above) simple in terms of labour in that, apart from the operation of the crane to maneuver the balcony, human input is only required to guide the balcony bracket 36*a* onto the wall bracket 34*a* and no further fixing operations are required whilst the balcony 10 is suspended by the crane.

It will be appreciated that the upper latch assembly 60 defines a self-engaging means of mechanically coupling the upper wall bracket 34*a* to the upper balcony bracket 36*a*, e.g. without requiring any manipulation by a worker. Therefore, the upper latch assembly 60 is configured to mechanically secure the balcony 10 in its mounted position without the need for a worker to be present in the immediate vicinity of the installation site during the initial stages of the installation, which thereby reduces the risk of injury to the worker.

Once the balcony 10 is arranged in the mounted position, its weight is supported by the upper and lower wall brackets 34*a*, 34*b*. In this mounted state, the upper latch assembly 60 provides a semi-permanent attachment between the upper balcony bracket 36*a* and the upper wall bracket 34*a* so that the balcony 10 cannot be dislodged whilst the worker completes the installation. Accordingly, the latching assembly 60 allows the balcony 10 to be mounted (i.e. moved into its mounted position on the building) and secured to the building in a single motion.

The method then proceeds to method steps 206 and 208 which may be performed simultaneously, or in any sequence. For the method step 206, the upper latch assembly 60 is tightened by adjusting the adjustment head 82 of the upper balcony bracket 36*a*, as described above. This tightening adjustment applies a tensile force between the latch 60 and the upper wall bracket 34*a* which pulls the balcony 10 towards the building and thereby further secures it in the mounted position. This adjustment can be easily performed by a worker who is positioned in the building, and who can then simply reach out to the balcony 10, safe in the knowledge that the balcony 10 is latched to the construction by the upper latch assembly 60.

The method step 208 comprises tightening the lower latch assembly 62 by adjusting the nuts 108 of the lower balcony bracket 36*b*, as described above. This adjustment applies a compressive force between the lower latch 100 and the lower wall bracket 34*b* such that the weight of the balcony is supported by the wall bracket. It also locks the upstanding protrusion 98 within the aperture 102 of the lower latch 100, such that there can be no lateral movement between the balcony 10 and the lower wall bracket 34*b*.

Figure 12:
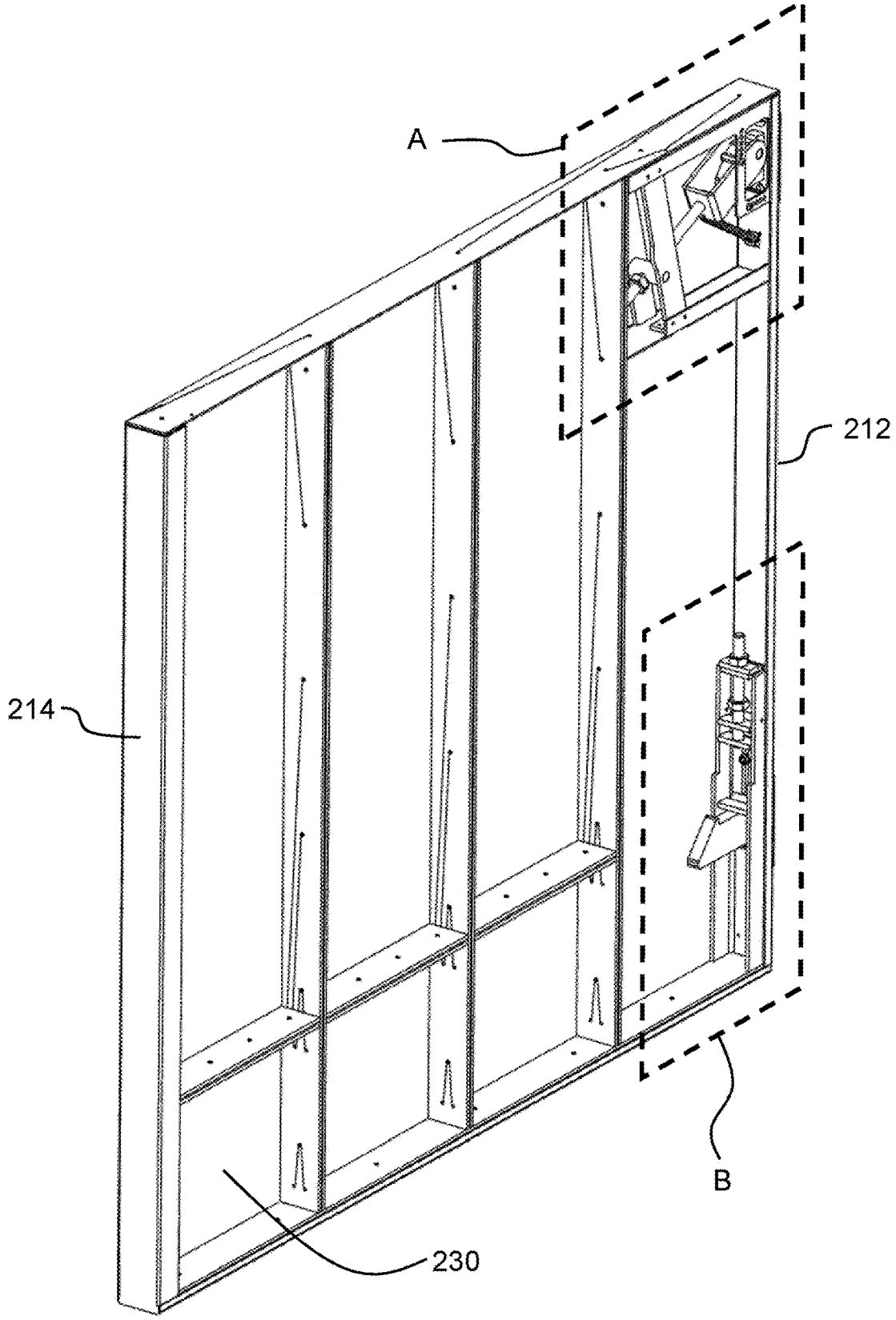
FIG. 12 shows a perspective view of a side wall of a balcony system according to another embodiment of the present invention.

FIG. 12 shows a perspective view of a side wall of a balcony system according to a second embodiment of the present invention. It is intended that the remainder of the balcony system, other than the two side walls, would be similar to those shown in the first embodiment (see FIG. 1) and so these features of the balcony are not shown in FIGS. 12-27.

As for the first embodiment, the balcony of the second embodiment is intended to be arranged in an upright orientation when mounted to a construction (not shown), or building.

The balcony of the second embodiment has an inner side 212 and an outer side 214 arranged to face towards and away from the building, respectively, when the balcony is in a mounted position. It will be appreciated that when the balcony is in use, the outer side 214 is substantially cantilevered from the building, whereas the inner side 212 is arranged adjacent to an external wall of the building. The balcony also includes left and right lateral sides as viewed facing the building. What is shown in FIG. 12 is the left lateral side of the balcony, without showing the balcony cassette, balustrade, etc. of the balcony, for which reference is made to FIG. 1.

Figure 13:
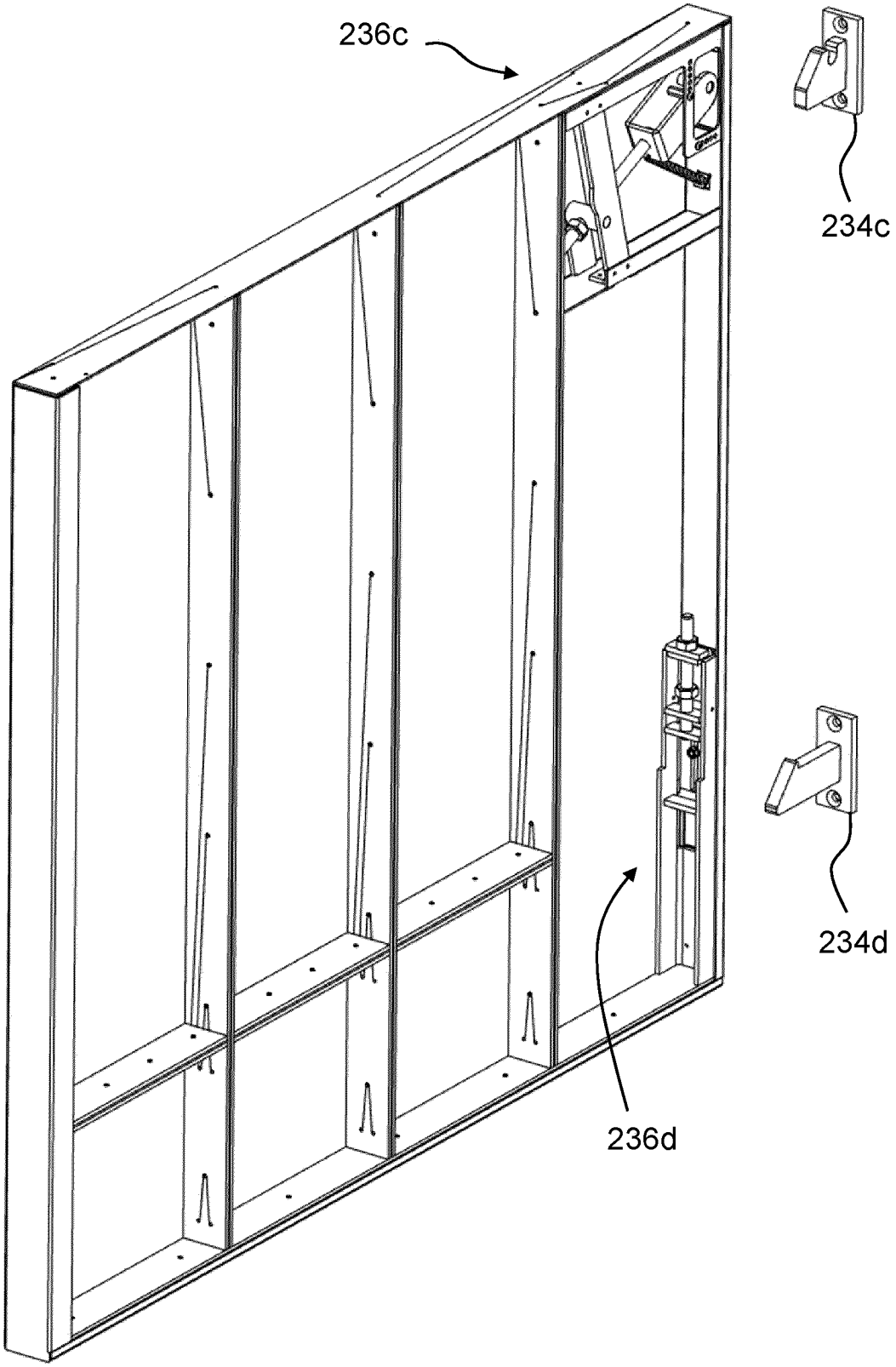
FIG. 13 shows the balcony system of FIG. 12 separated from the wall brackets.

Upper wall bracket 234*c* and lower wall bracket 234*d* are shown in FIG. 13. These cooperate with upper and lower balcony brackets 236*c*, 236*d*, respectively to form upper and lower attachments for the side wall of the balcony. It will be appreciated that corresponding wall brackets and balcony brackets are provided for the other side wall of the balcony and that the attachment of the balcony cassette to the side walls ensures that the balcony is supported form the construction via the wall brackets and balcony brackets.

The wall brackets are attached to the construction in a similar manner as for the first embodiment. The wall brackets have a similar shape and configuration as for the first embodiment.

Described next is the manner in which the wall brackets and balcony brackets are latched together in order to secure the balcony to the building.

Side panel 230 has the form of a generally flat sheet but with inner and outer ends bent to form vertical U-shaped channels at the inner side 212 and the outer side 214. The side panel 230 is configured to provide structural support to the balcony by transmitting cantilever forces associated with the suspended mass of the balcony to the wall brackets. In this way, the side panel 230 defines a stress skin of the balcony. In alternative embodiments (not shown) there may be a reinforcing construction formed at the interior of the side panel to transmit said cantilever forces.

Figure 14:
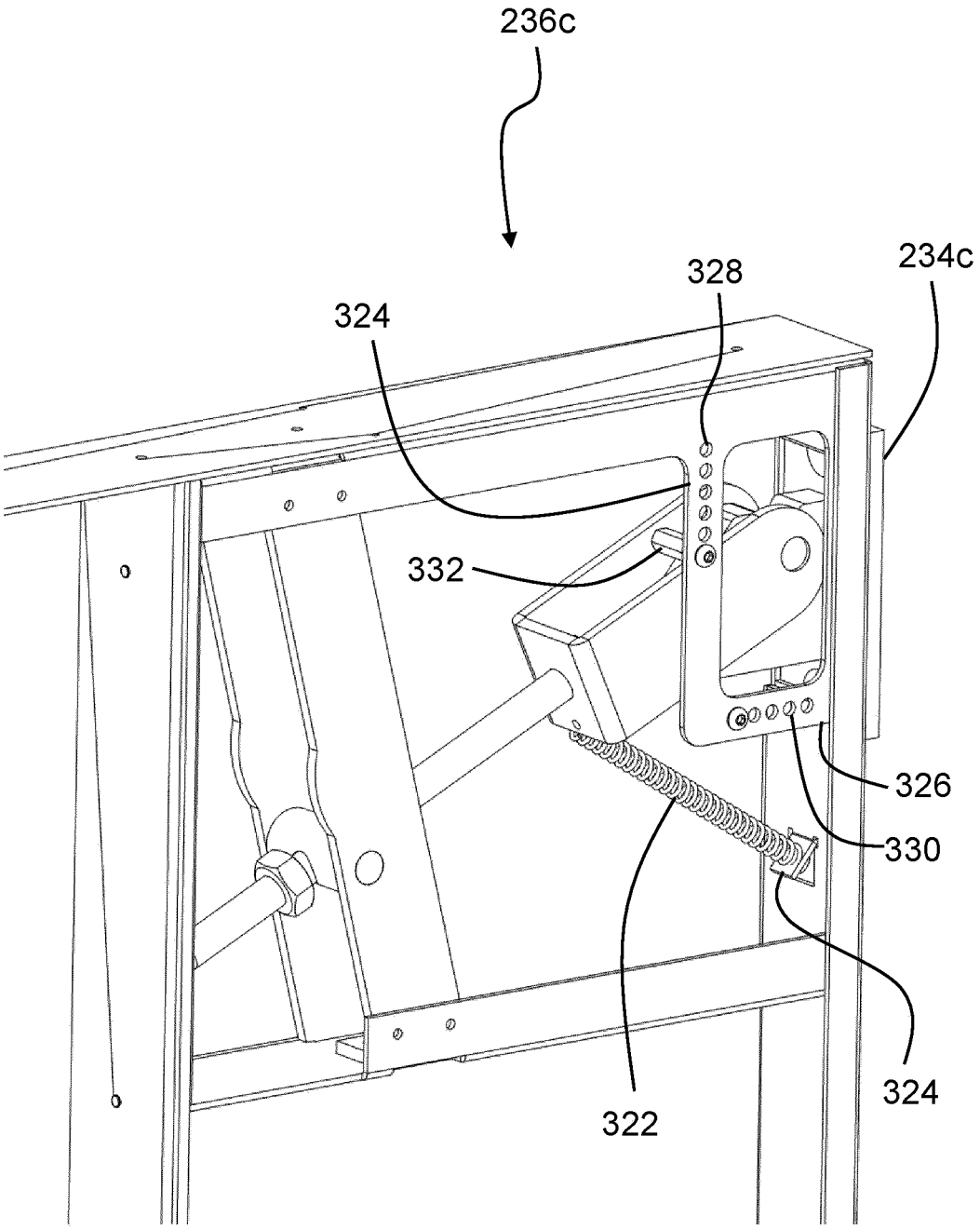
FIG. 14 shows an enlarged view of region A from FIG. 12.
Figure 15:
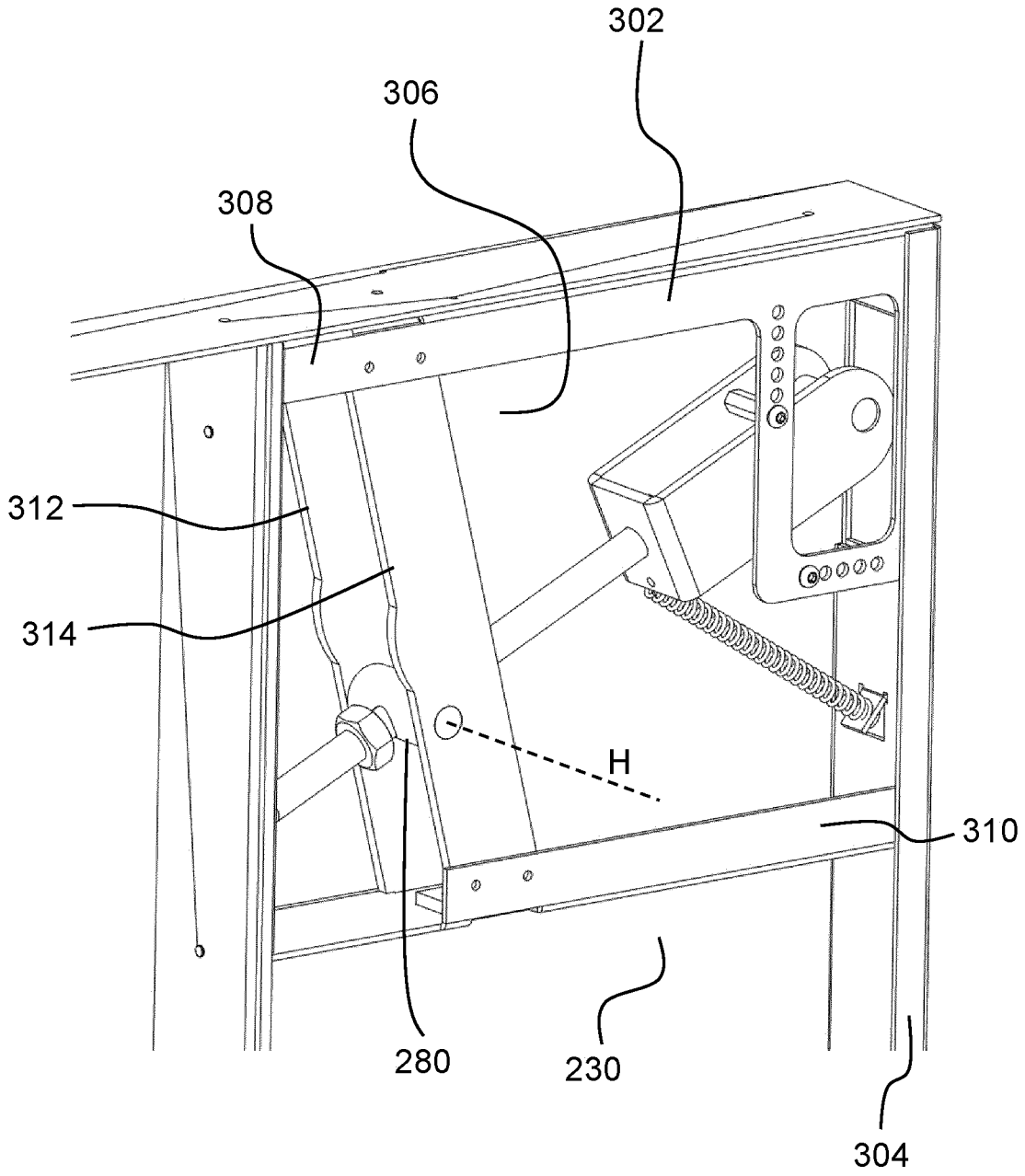
FIG. 15 shows a similar view to FIG. 14 but with the wall bracket removed from the view.
Figure 16:
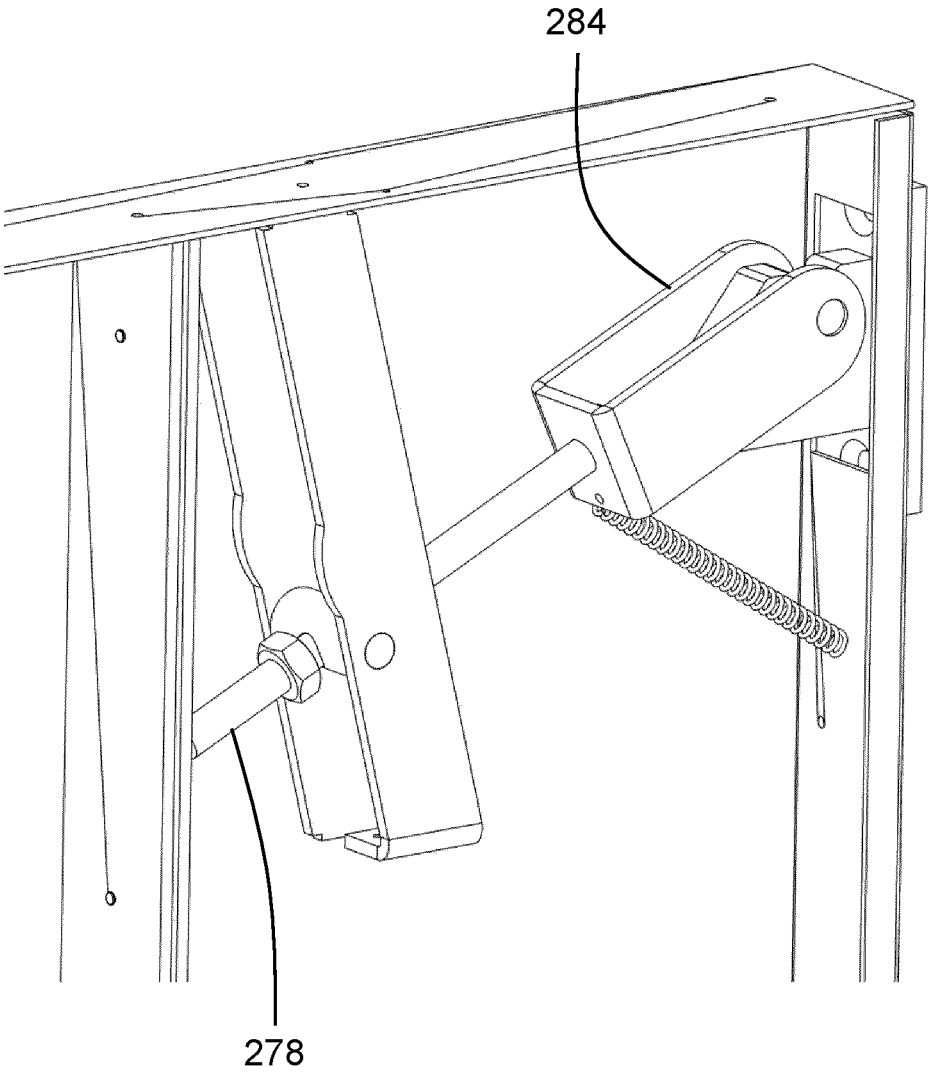
FIG. 16 shows a similar view to FIG. 15 but with the cage removed from the view.
Figure 17:
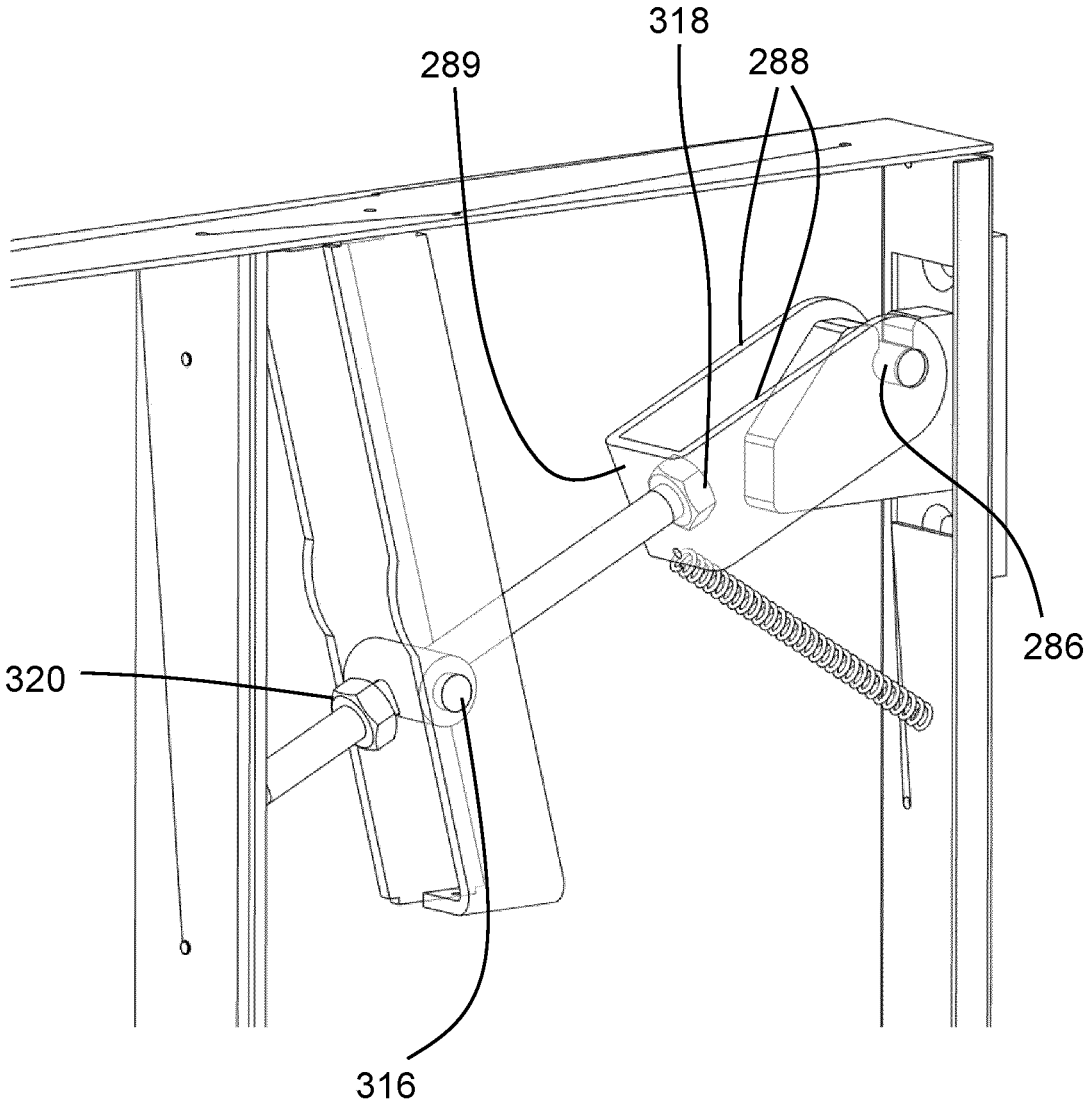
FIG. 17 shows a similar view to FIG. 16 but with the latch yoke made partially transparent and with one of the cage struts made partially transparent.
Figure 18:
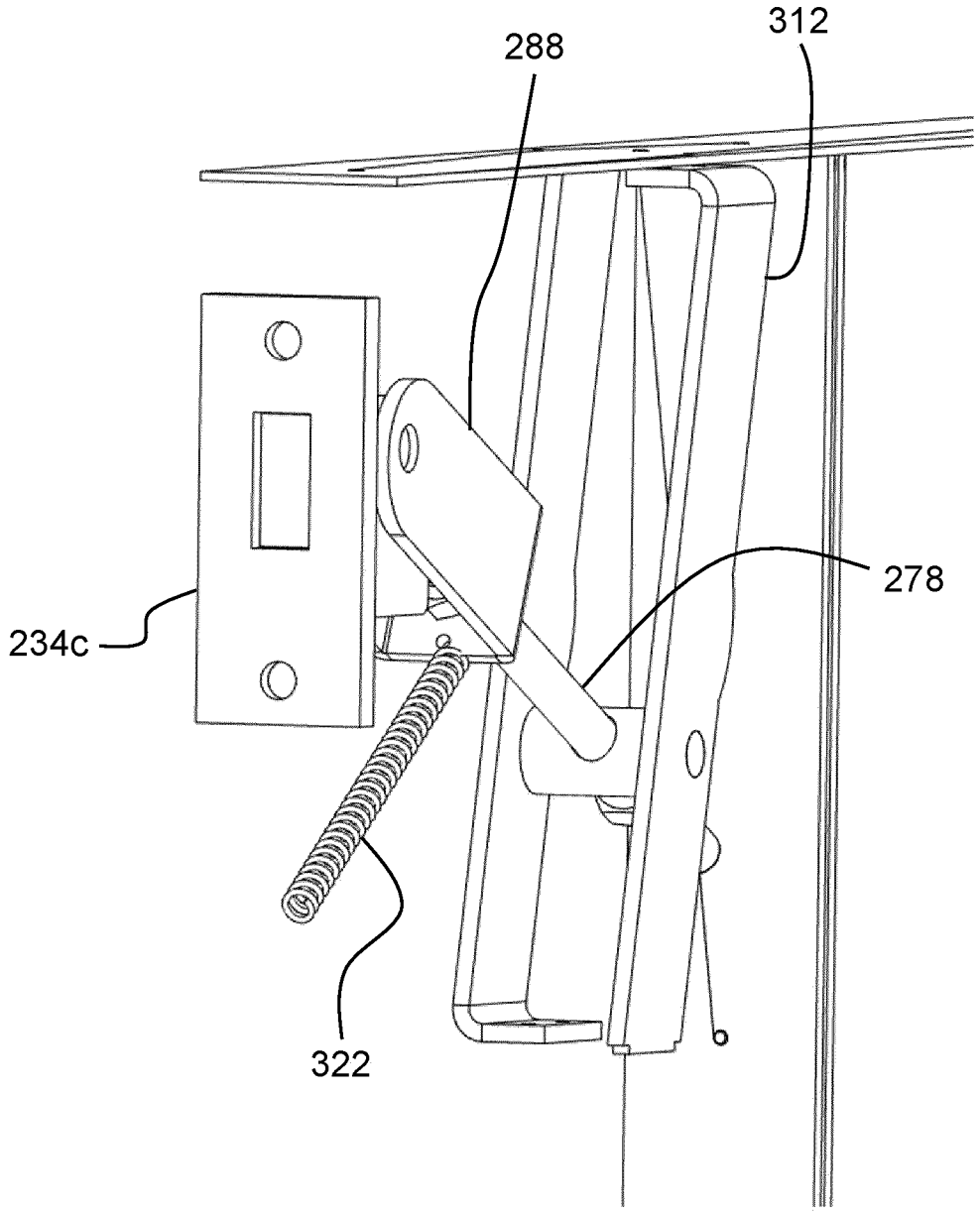
FIG. 18 shows the features shown in FIG. 14 but from an alternate viewpoint and with the side panel of the balcony removed from the view and with the cage removed from the view.
Figure 19:
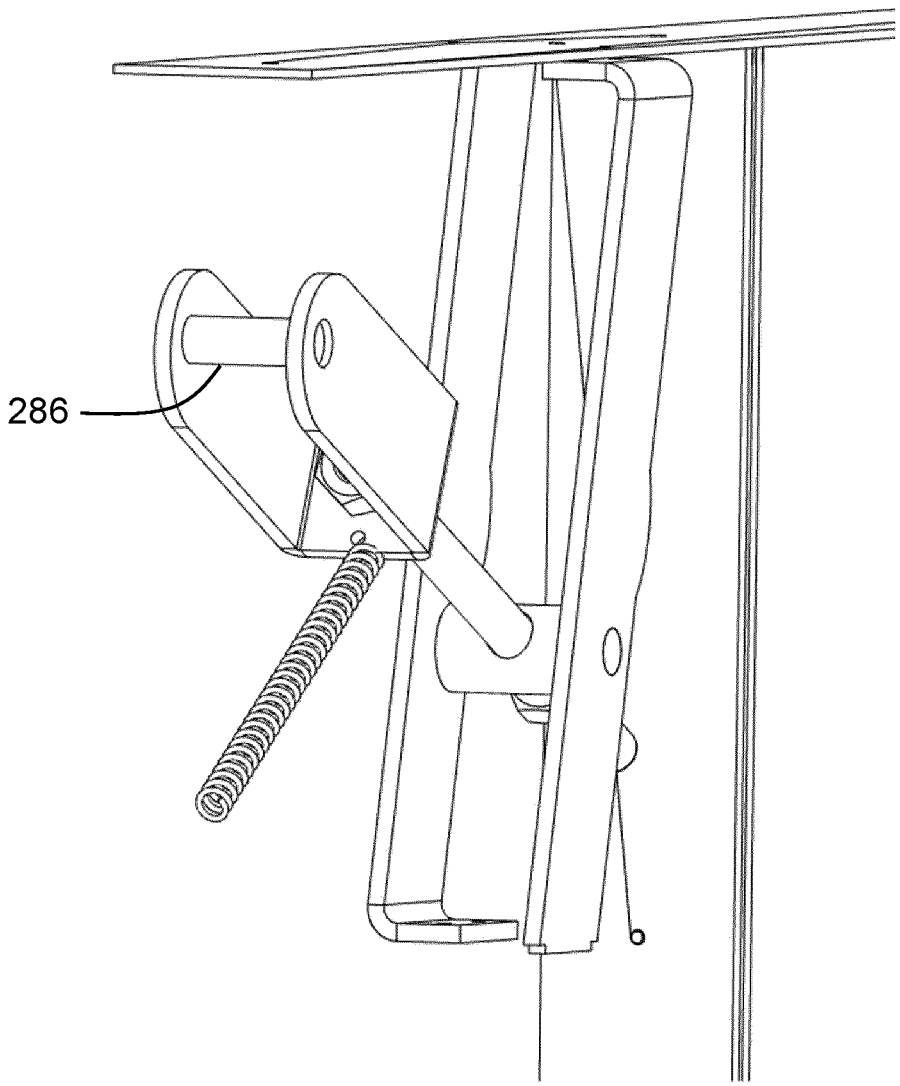
FIG. 19 shows a similar view to FIG. 18 but with the wall bracket also removed from the view.

FIG. 14 shows an enlarged view of region A from FIG. 12. This shows the arrangement of the upper balcony bracket 236*c* and its engagement with the upper wall bracket 234*c*. FIG. 15 shows a similar view to FIG. 14 but with the wall bracket removed from the view. Continuing to refer to FIG. 15, cage 302 is attached to the bent vertical lip 304 of the side panel 230 and has a back wall 306 that is parallel to the main face of the side panel 230. The cage has top 308 and bottom 310 lips that are bent to be vertical and extend horizontally. Cage struts 312, 314 extent between and are attached to top 308 and bottom 310 lips. Each cage strut has a horizontally extending aperture that receives a corresponding lug 316 (see FIG. 17) extending horizontally from yoke block 280 that is oriented horizontally and extends between the cage struts and is rotatable about a horizontal axis of rotation indicated by H.

Yoke block 280 has a smooth bore aperture extending through is, in a direction perpendicular to axis H. Extending through the aperture is threaded stud 278 with a free end distal from the building and with its opposite end coupled to yoke 284 via nut 318 (see FIG. 17). Nut 320 is threaded onto threaded stud 278 to bear against the distal side of yoke block 280.

Yoke 284 includes a yoke pin 286 which is configured to engage with the upper wall bracket 234*c* in a manner similar to that described with respect to the first embodiment. The yoke pin 286 extends between two side supports 288 which define a substantially U-shaped member of the yoke 284. A connecting wall 289 is provided to join together the two side supports 288 at a distal end of the yoke 284 (i.e. the end which does not comprise the yoke pin 286). The connecting wall 289 is arranged substantially perpendicular to the side supports 288. In this way, the yoke 284 defines a folded fork comprising two projections (i.e. the two side supports 288) which receive the projecting part of the upper wall bracket.

As will be understood, threaded stud 278 is capable of rotation about axis H and therefore the yoke 284 is also capable of rotation about the same axis. This permits the yoke pin 286 to be displaced around this axis of rotation when the leading edge of the wall bracket is pushed against the yoke pin, and subsequently to fall into the recess of the wall bracket in order to be latched into position. However, as how described, the movement of the yoke 284 is further constrained. Spring 322 is provided, extending between the connecting wall 289 of the yoke and a tab 324 bent out from and attached to the cage 302 at the building side of the balcony. Spring 322 is in tension and urged the yoke towards the latched configuration. Accordingly, as the wall bracket is pushed in, this pushes the yoke upwardly, against the urging of the spring 322.

The cage 302 additionally has a sub-frame with vertical part 324 and horizontal part 326. The vertical part 324 and horizontal part 326 of the sub-frame each have an array of adjustment apertures 328, 330 into which may be inserted limit pins 332. Limit pins extend from the sub-frame of the cage to define stops for limiting the movement of the yoke 284. This avoids the yoke moving too far, in particular before attachment of the balcony to the building, and ensures that the yoke is presented in a suitable orientation to the wall bracket during the balcony installation process. The lower limit pin corresponds for example to a latch support since it is configured to support the latch in the unlatched configuration.

After latching engagement has been achieved between the yoke and the wall bracket, nut 320 is tightened in order to secure the yoke pin 286 with respect to the wall bracket.

Turning now to the engagement between the lower wall bracket and the lower balcony bracket, we refer to FIGS. 20-27.

Figure 20:
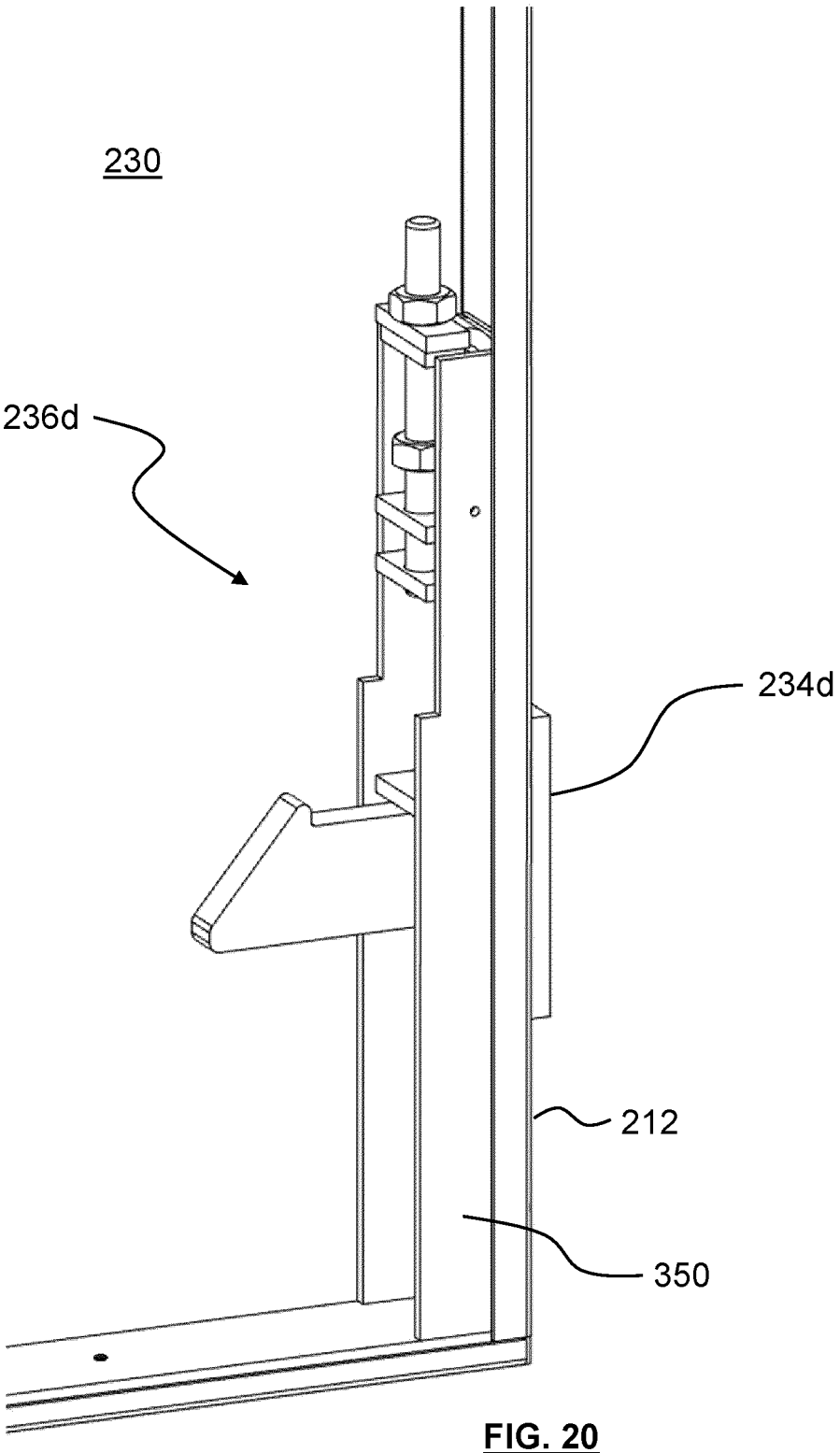
FIG. 20 shows an enlarged view of region B from FIG. 12.

FIG. 20 shows an enlarged view of region B from FIG. 12, showing the positioning of the lower balcony bracket 236*d* with respect to the side panel 230 and the lower wall bracket 234*d*. The lower balcony bracket 236*d* is retained with respect to the side panel 230 by upstand 350 which is located in and secured to the vertical U-shaped channel of the side panel 230 at the inner side 212.

Figure 21:
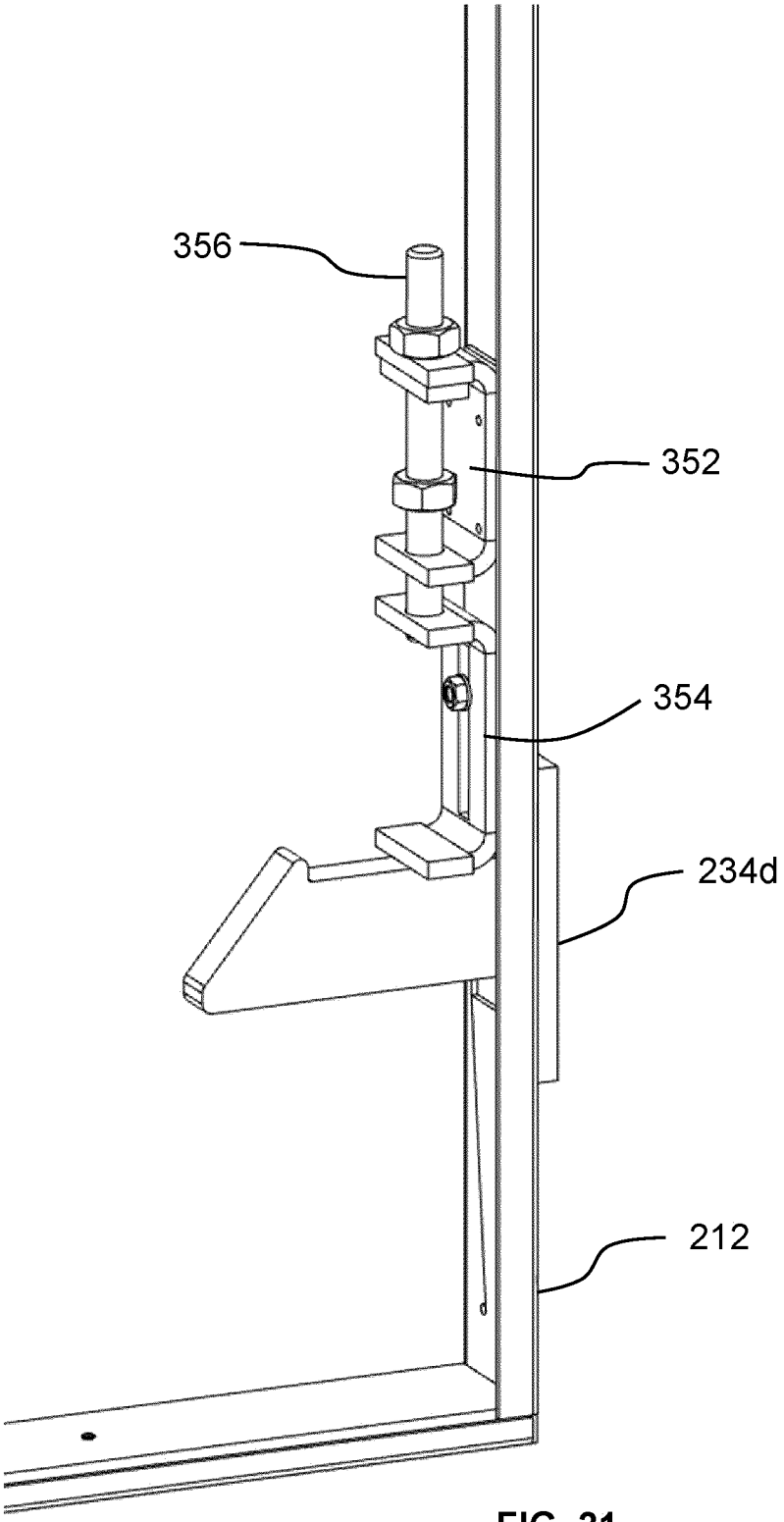
FIG. 21 shows a similar view to FIG. 20 but with the upstand removed from the view.
Figure 22:
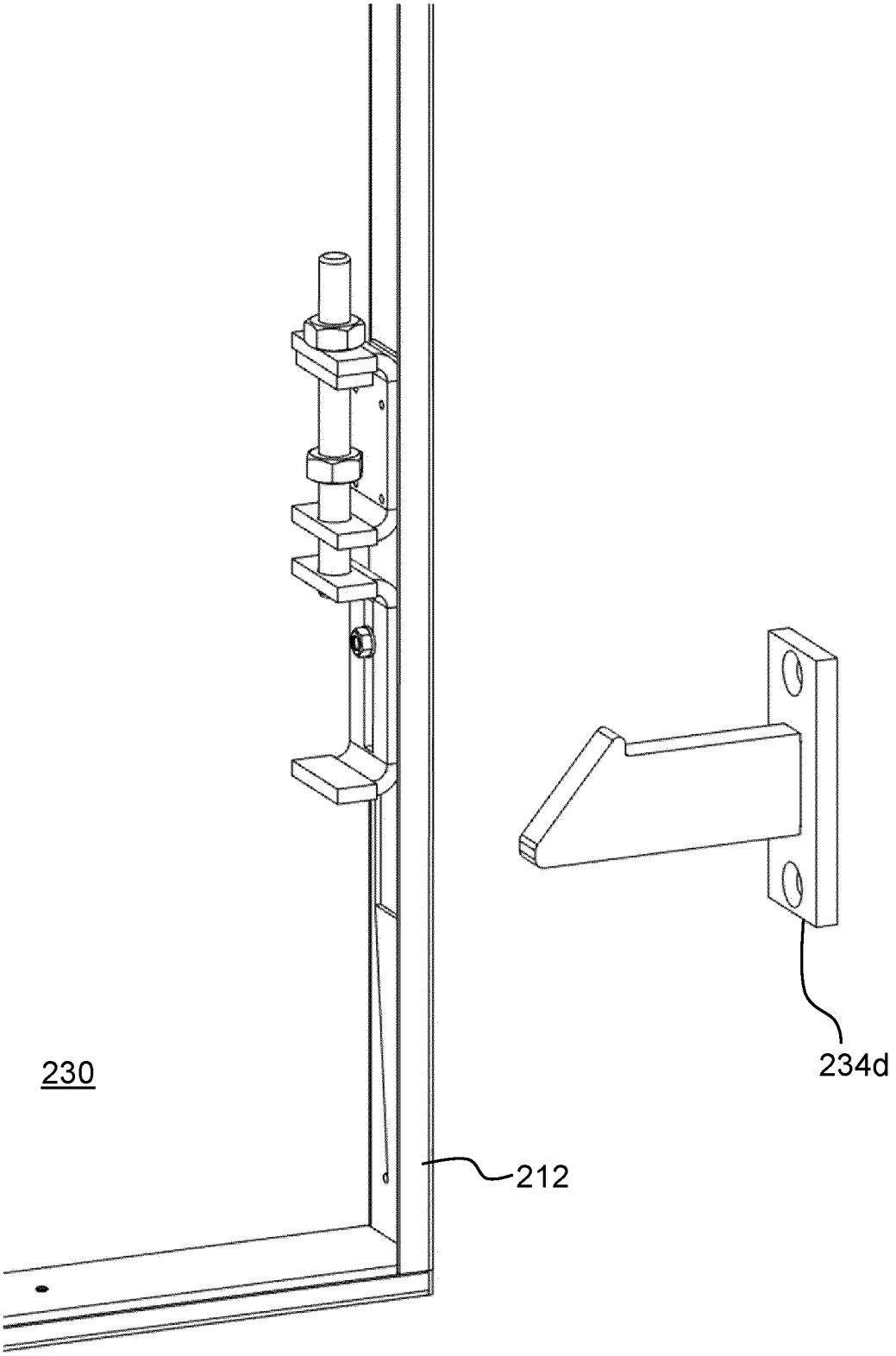
FIG. 22 shows a similar view to FIG. 21 but with the wall bracket displaced from the view.
Figure 23:
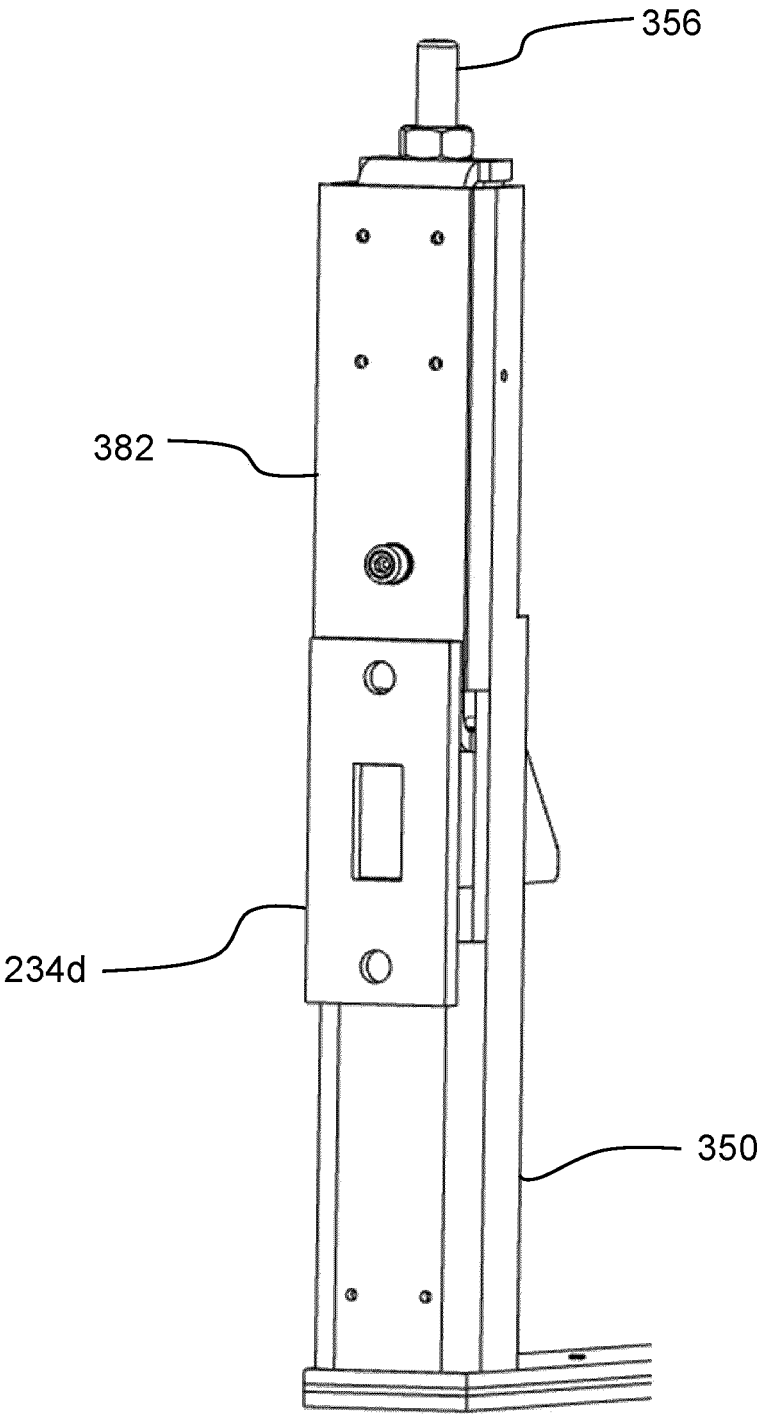
FIG. 23 shows the features shown in FIG. 20 but from an alternate viewpoint and with the side panel of the balcony removed from the view.
Figure 24:
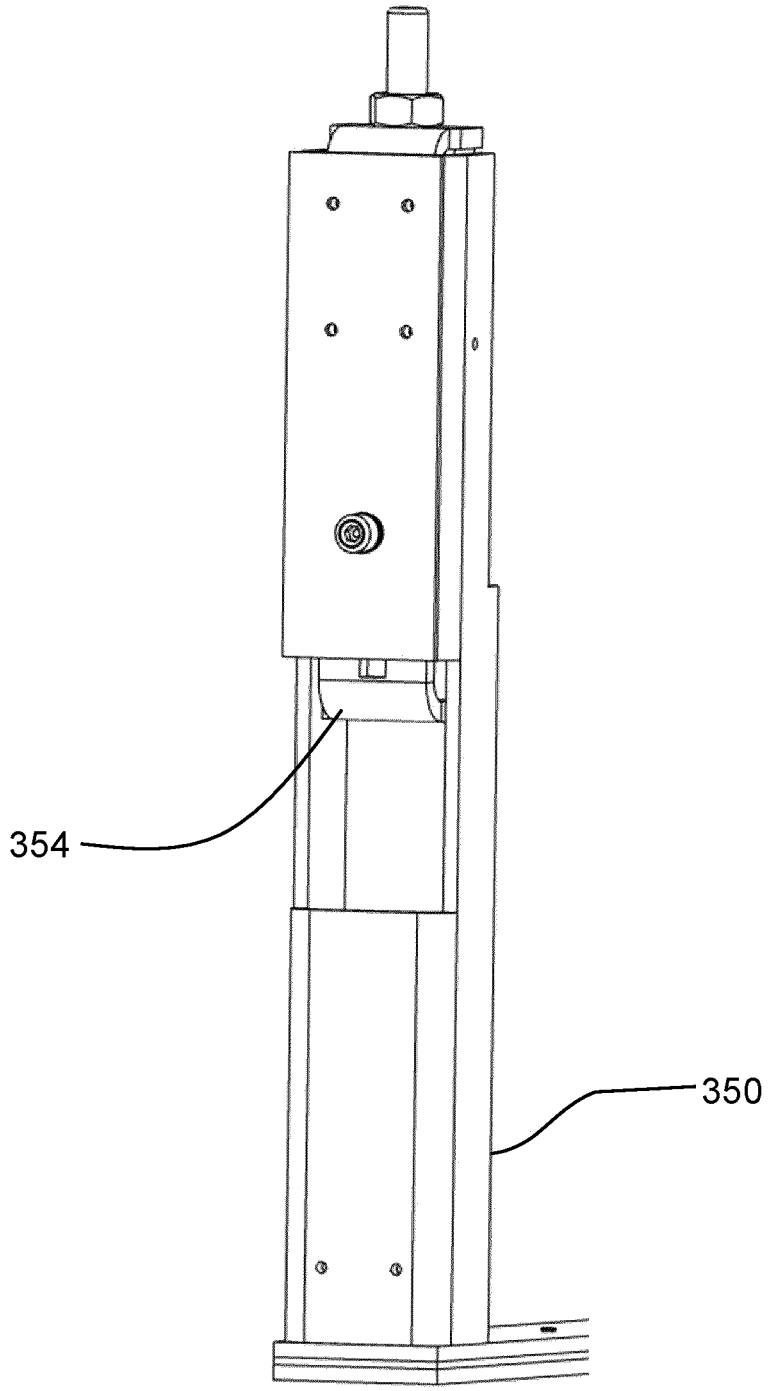
FIG. 24 shows a similar view to FIG. 23 but with the wall bracket also removed from the view.
Figure 25:
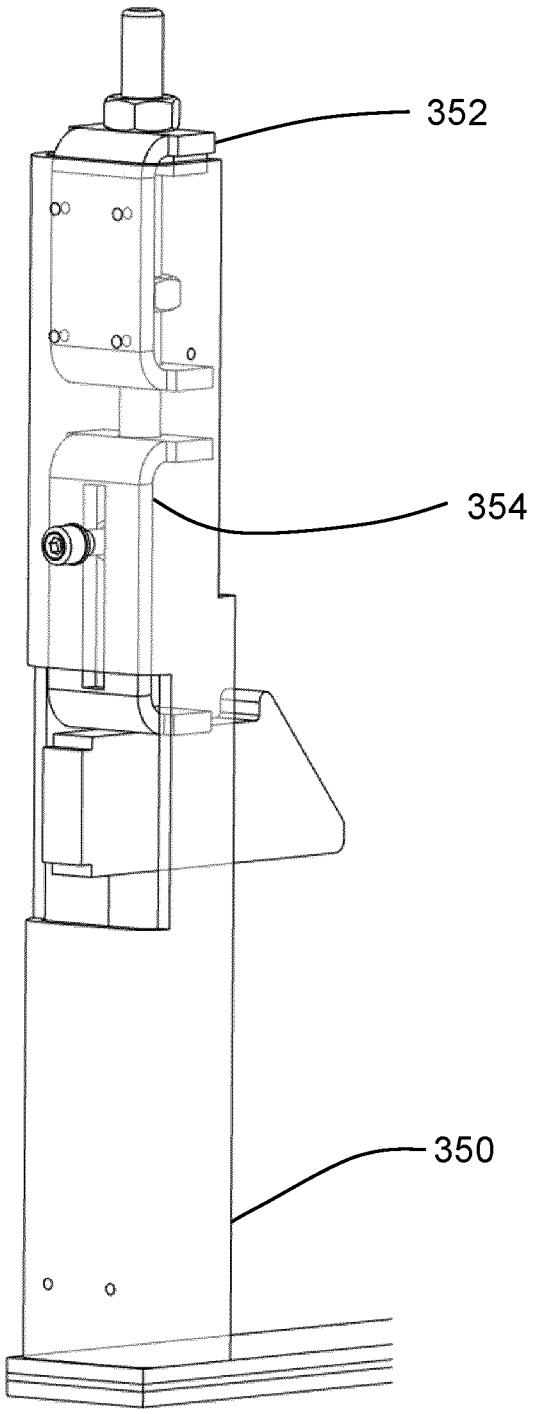
FIG. 25 shows a similar view to FIG. 24 but with the upstand made partially transparent.

FIG. 21 shows a similar view to FIG. 20 but with the upstand 350 removed from the view. FIG. 22 shows a similar view to FIG. 21 but with the wall bracket 234*d* displaced from the view.

The lower balcony bracket 236*d* includes a top U-shaped bracket 352 and a bottom U-shaped bracket 354 connected via threaded stud 356. Top U-shaped bracket 352 has generally horizontal plate portions 358, 360 connected by a generally vertical plate portion 362. Similarly, bottom U-shaped bracket 354 has generally horizontal plate portions 364, 366 connected by a generally vertical plate portion 368.

Threaded stud 356 is arranged substantially vertically and extends through vertical holes formed through horizontal plates 358, 360 of the top U-shaped bracket. It is secured in place by top nut 370 and spacer 372 located respectively above and below horizontal plate 358. Adjustment nut 374 is located between the spacer 372 and horizontal bracket 360.

For the a bottom U-shaped bracket 354, horizontal plate 364 is secured with respect to the threaded bolt, for example by welding. Accordingly, the height of the bottom U-shaped bracket 354 can be set by nuts 370, 374 on the threaded stud 356. Additionally, vertical plate portion 368 of the bottom U-shaped bracket has a vertically extending slot 376 through which bolt 378 passes and is secured by nut 380. In turn, bolt passes through a corresponding hole through the upstand (not shown in FIG. 26) and rear plate 382 which is secured with respect to the upstand and side panel 230 as well as to the top U-shaped bracket 352.

Figure 26:
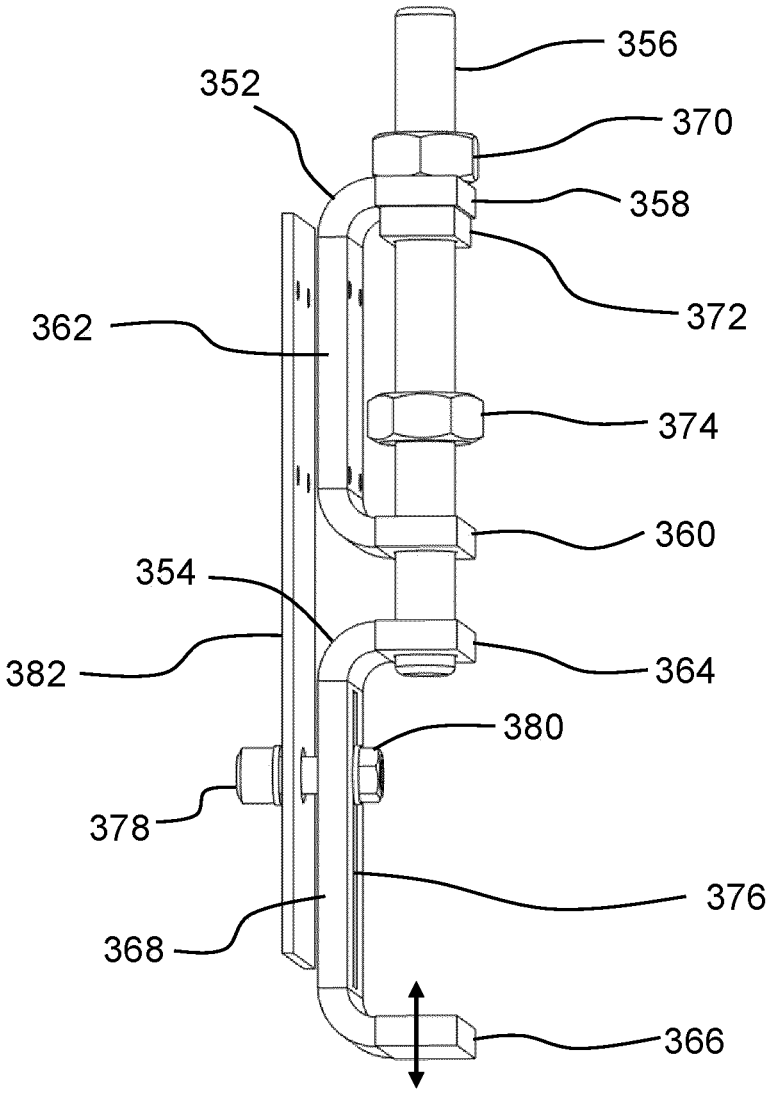
FIG. 26 shows similar features to FIG. 22 but from a different viewpoint and with the wall bracket and the side panel of the balcony removed from the view.
Figure 27:
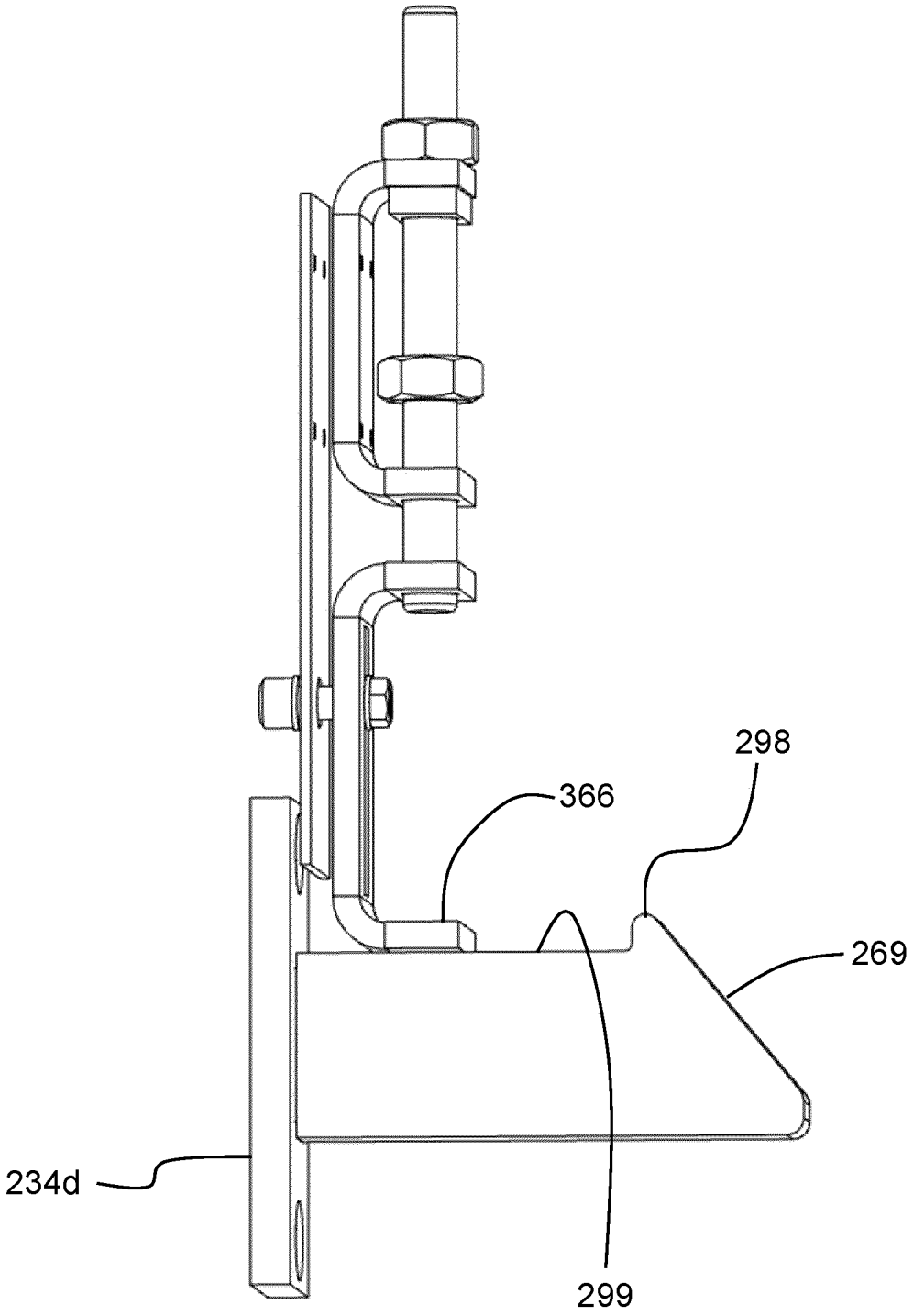
FIG. 27 shows a similar view to FIG. 26 but with the wall bracket in place.

As shown in FIG. 26, this arrangement allows the bottom U-shaped bracket 354 to moved vertically provided that there is sufficient slack between the bolt 378 and nut 380 and provided that the nut 374 is not yet tightened against spacer 372. Accordingly, as shown in FIG. 27, the horizontal plate 366 of the bottom U-shaped bracket 354 can bear against the angled leading face 269 of the lower wall bracket 234*d* and be displaced upwardly by it, ride over the upstanding projection 298 and then lie against top surface 299. Once in position, nuts 370, 374 and 380 can be tightened in order to secure the lower balcony bracket to the lower wall bracket, this ensuring that the bottom U-shaped bracket 354 is not capable of moving upwardly to allow the release of the lower wall bracket.

It will be understood therefore that the arrangement of the upper wall bracket and the upper balcony bracket provides a latch assembly that permits latching of the upper balcony bracket onto the upper wall bracket to provide support for the balcony during the installation process. Subsequently, the arrangement of the lower wall bracket and the lower balcony bracket provides a further latch assembly that permits latching of the lower balcony bracket onto the lower wall bracket to provide further support for the balcony. The latching arrangements ensure ease of installation while reducing the risk of the balcony detaching from either the upper or lower wall brackets during the installation procedure or subsequently.

Figure 11:
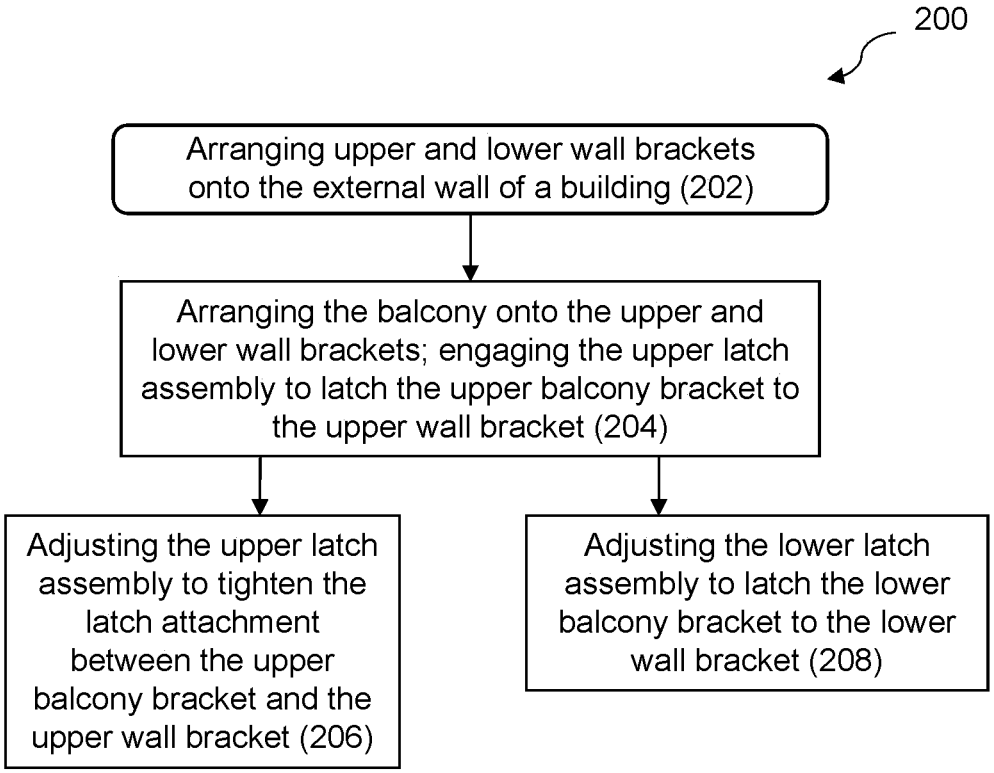
FIG. 11 is a flowchart illustrating a method of installing the balcony according to an embodiment of the present invention.

The balcony according to the second embodiment can be attached to a building following the corresponding steps already described with respect to FIG. 11.

Although the embodiments of the invention described above have been set out with precise dimensions it will be apparent to the skilled person that these dimensions are purely illustrative of specific embodiments of the present invention and that the dimensions can be varied depending on the configuration of the balcony desired without departing from the scope of the present invention.

While exemplary embodiments have been described above, many equivalent modifications and variations will be apparent to those skilled in the art when given this disclosure. Accordingly, the exemplary embodiments set forth above are considered to be illustrative and not limiting.

Throughout this specification, unless the context requires otherwise, the words "have", "comprise", and "include", and variations such as "having", "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means, for example, +/−10%.

The words "preferred" and "preferably" are used herein refer to embodiments of the invention that may provide certain benefits under some circumstances. It is to be appreciated, however, that other embodiments may also be preferred under the same or different circumstances. The recitation of one or more preferred embodiments therefore does not mean or imply that other embodiments are not useful, and is not intended to exclude other embodiments from the scope of the disclosure, or from the scope of the claims.

The invention claimed is:

1. A balcony for attachment to a construction, there being a plurality of wall brackets fitted to the construction, the balcony comprising:

a plurality of balcony brackets on one side of the balcony which are arranged to engage with the plurality of wall brackets, including a first balcony bracket arranged to engage with a first wall bracket and a second balcony bracket arranged to engage with a second wall bracket, so as to cause the weight of the balcony to be supported by the construction when the balcony is arranged in a mounted position, wherein the first balcony bracket is spaced apart from the second balcony bracket in a substantially vertical direction; and a latch assembly which is configured, when the balcony is arranged in the mounted position, to latch the first balcony bracket to the first wall bracket to securely attach the balcony to the construction, wherein the latch assembly comprises a latch which is configured to be movable from an unlatched configuration to a latched configuration by the balcony being moved into the mounted position.

2. The balcony according to claim 1, wherein the latch is pivotably coupled to the balcony about a substantially horizontal pivot axis to allow rotation of the latch in a substantially vertical plane.

3. The balcony according to claim 1, wherein the latch assembly comprises a tapered leading end of the first wall bracket which is configured, when the balcony is moved into the mounted position, to urge the latch from the unlatched configuration to the latched configuration.

4. The balcony according to claim 1, wherein the latch assembly comprises a latch support which is configured to support the latch in the unlatched configuration.

5. The balcony according to claim 1, wherein the latch assembly comprises a concave depression arranged on an upper surface of the first wall bracket, the concave depression is configured to receive the latch when the latch is arranged in the latched configuration.

6. The balcony according to claim 5, wherein the second member comprises a threaded bore and a threaded end of the first member is configured to be received within the threaded bore to control the relative movement between the first and second members.

7. The balcony according to claim 1, wherein the latch assembly comprises a first member which is pivotably coupled to the balcony, and a second member which forms the latch, wherein the first member is adjustably coupled to the second member to allow relative movement therebetween.

8. The balcony according to claim 1, wherein the latch assembly includes an elastic member configured to urge the latch towards the latched configuration and to permit movement of the latch towards the unlatched configuration.

9. The balcony according to claim 8, wherein the latch assembly defines a first latch assembly, and the balcony comprises a second latch assembly which is configured to latch the second balcony bracket to the second wall bracket once the balcony has been secured to the construction by the first latch assembly.

10. The balcony according to claim 9, wherein the second latch assembly comprises first and second members which are adjustably coupled together to allow relative movement therebetween, the second member defines the latch of the second latch assembly which comprises a threaded end which is threadedly coupled to the first member to cause the latch to engage with the upstanding protrusion of the second latch assembly.

11. The balcony according to claim 1, wherein the first balcony bracket is arranged substantially above the second balcony bracket.

12. The balcony according to claim 11, wherein the second latch assembly comprises an upstanding protrusion arranged on an upper surface of the second wall bracket, and wherein the second latch assembly comprises a latch which defines a horizontal plate of the second balcony bracket to be received at least partially behind the upstanding protrusion to fixedly attach the balcony to the construction.

13. A balcony system comprising a balcony for attachment to a construction and a plurality of wall brackets, wherein the balcony comprises:

a plurality of balcony brackets on one side of the balcony which are arranged to engage with the plurality of wall brackets, including a first balcony bracket arranged to engage with a first wall bracket and a second balcony bracket arranged to engage with a second wall bracket, so as to cause the weight of the balcony to be supported by a construction when the balcony is arranged in a mounted position, wherein the first balcony bracket is spaced apart from the second balcony bracket in a substantially vertical direction; and a latch assembly which is configured, when the balcony is arranged in the mounted position, to latch the first balcony bracket to the first wall bracket to securely attach the balcony to the construction, wherein the latch assembly comprises a latch which is configured to be movable from an unlatched configuration to a latched configuration by the balcony being moved into the mounted position.

14. A method of attaching a balcony to a building or other construction, the method comprising the steps of:

fitting a plurality of wall brackets to the construction; and attaching a balcony having a plurality of balcony brackets on one side of the balcony which are arranged to engage with the plurality of wall brackets, including a first balcony bracket arranged to engage with a first wall bracket and a second balcony bracket arranged to engage with a second wall bracket, so as to cause the weight of the balcony to be supported by the construction when the balcony is arranged in a mounted position;

wherein the first balcony bracket is spaced apart from the second balcony bracket in a substantially vertical direction, and wherein the balcony comprises a latch assembly which is configured, when the balcony is arranged in the mounted position, to securely attach the balcony to the construction;

wherein attaching the balcony comprises:

moving the first wall bracket and the first balcony bracket together to cause the latch assembly to latch the first wall bracket to the first balcony bracket; and adjusting the latch assembly to tighten the attachment between the wall bracket and the balcony bracket.

* * * * *